US005946008A

United States Patent [19]

Nishizawa et al.

[11] Patent Number: 5,946,008

[45] Date of Patent: Aug. 31, 1999

[54] INK-JET PRINTER FOR IMPROVING THE FREEDOM OF MOVEMENT OF THE CARRIAGE DURING A CLEANING OPERATION

[75] Inventors: Atsushi Nishizawa; Masanori Yoshida, both of Nagano, Japan

[73] Assignee: Seiko Epson Corporation, Tokyo, Japan

[21] Appl. No.: 08/768,634

[22] Filed: Dec. 18, 1996

[30] Foreign Application Priority Data

Dec. 19, 1995 [JP] Japan ..... 7-348816

[51] Int. Cl.[6] ..... B41J 2/165

[52] U.S. Cl. ..... 347/30; 347/32

[58] Field of Search ..... 342/30, 31, 33, 342/29, 37

[56] References Cited

U.S. PATENT DOCUMENTS

| | | | |
|---|---|---|---|
| 4,745,414 | 5/1988 | Okamura et al. | 347/30 |
| 5,379,061 | 1/1995 | Yamaguchi et al. | 347/30 |

FOREIGN PATENT DOCUMENTS

| | | | |
|---|---|---|---|
| 495669 | 7/1992 | European Pat. Off. . | |
| 526209 | 2/1993 | European Pat. Off. . | |
| 576033 | 12/1993 | European Pat. Off. . | |
| 4-251753 | 9/1992 | Japan | 347/32 |
| 2284576 | 6/1995 | United Kingdom . | |

OTHER PUBLICATIONS

Patent Abstracts of Japan, vol. 18, No. 398 (M–1645), Apr. 26, 1994.

*Primary Examiner*—N. Le
*Assistant Examiner*—Thien Tran
*Attorney, Agent, or Firm*—Sughrue, Mion, Zinn, Macpeak & Seas, PLLC

[57] ABSTRACT

An apparatus and method for improving the freedom of movement of a carriage of an ink jet printer while a suction pump of the printer is being driven. The ink jet printer includes a carriage which reciprocates in a direction perpendicular to a direction in which printing paper is conveyed by a paper conveyor, a head, housed on the carriage, for printing characters on the printing paper, and a cap which is joinable tightly to the ink-jet face of the head. The printer further includes a suction pump communicating with the cap, a pump driving mechanism, a motor capable of driving the pump driving mechanism, and a switching gear capable of transferring the motive power of the motor selectively to and away from the pump driving mechanism as controlled by the apparatus. The apparatus includes structure which form paths through which an operating projection movably fitted to the carriage. A changeover holding device has driven portions projecting in the paths in which the operating projection moves, and operates to shift the switching gear to and from a position to enable the motor to drive the suction pump. Specifically, the paths includes operating paths in which the changeover holding device is actuated by the operating projection, and non-operating paths where the changeover holding device is not actuated when the operating projection passes through them.

18 Claims, 20 Drawing Sheets

INK-JET PRINTER FOR IMPROVING THE FREEDOM OF MOVEMENT OF THE CARRIAGE DURING A CLEANING OPERATION

FIELD OF THE INVENTION

The present invention relates to an ink-jet printer and, in particular, an ink-jet printer having a print head mounted to a reciprocating carriage and a print head cleaning mechanism, such that the freedom of movement of the reciprocating carriage is not restricted when the cleaning mechanism is operated.

DESCRIPTION OF THE RELATED ART

A typical ink-jet printer normally has a printing area in which characters are printed by a head which is fitted to a carriage capable of reciprocating in a direction perpendicular to a paper feeding direction, and a nonprinting area which is adjacent to and positioned outside of the printing area and not affected by the printing operation performed by the head. In such a typical ink-jet printer, a capping operation is performed during which the head is covered with a cap to prevent dried ink from clogging the nozzles when the printing operation is not performed for a certain period of time.

However, if the nozzles of the head become clogged with dried ink, a pumping operation is needed in which the cap is tightly secured to the ink-jet face (nozzle face) of the head in order to suck the ink forcibly out of the nozzles via a suction pump. Furthermore, a cleaning operation is needed to remove dust, such as paper particles sticking to the ink-jet face of the head, by rubbing the ink-jet face with felt or silicone rubber.

Also, even during a printing operation, a specific nozzle may not jet out ink for a long period of time, depending on the printing pattern. If this condition continues, that nozzle may become clogged with dried ink at its tip. Therefore, a flushing operation is needed in which the entire group of nozzles jet out ink periodically.

These capping, pumping, cleaning and flushing operations are performed while the carriage, and hence, the head, stays in the nonprinting area.

A standby position of the carriage is provided in the nonprinting area and the aforementioned capping operation is performed in this standby position. Therefore, if the carriage in the standby position is allowed to move unnecessarily, the capping may become unsecure, thus allowing the carriage to move while, for example, the printer is moved from one location to another. In order to prevent the carriage from moving toward the printing area, a stopper is typically used which projects toward the printing area of the carriage after the carriage has been moved from the printing area to the standby position.

In the typical ink-jet printer, a paper feeder is needed to feed paper during the printing operation. Although there are some known printers in which a motor for driving the paper feeder is provided separately from that which is used to drive the suction pump, printers commonly use one motor which selectively drives the paper feeder and the suction pump. In this type of printer, the motive power of the motor is transmitted to the suction pump when the carriage stays in a specific position (e.g., the standby position) of the nonprinting area, and the suction pump is thus driven. While the carriage stays in any other position, the motive power of the motor is transmitted to the paper feeder and the paper feeder is driven.

SUMMARY OF THE INVENTION

As discussed above, in a typical ink-jet printer in which one motor is employed for selectively driving the paper feeder and the suction pump, the motive power of the motor is transmitted to the suction pump when the carriage is in the specific position of the nonprinting area. Accordingly, the carriage must stay in that specific position when the suction pump is driven. While the suction pump is being driven, the carriage is not allowed to move from the specific position and therefore, the freedom of movement of the carriage is significantly reduced.

Also, in the typical printer, a stopper and a mechanism for operating the stopper are needed to prevent the carriage in the standby position from moving. This is accomplished by projecting the stopper toward the printing area of the carriage. Therefore, the number of parts and the complexity of the construction of the printer increases.

An object of the present invention, therefore, is to provide an ink-jet printer capable of improving the freedom of movement of the carriage while a suction pump is being driven. Another object of the present invention is to provide an ink-jet printer having a minimum number of parts and which is simple in construction.

In order to achieve the above objects, an ink-jet printer according to an embodiment of the present invention comprises a carriage which reciprocates in a direction perpendicular to a direction in which printing paper is conveyed by a paper conveyor, a head, which is fitted to the carriage, for printing characters by emitting jets of ink from the nozzles formed on an ink-jet face toward the printing paper, a cap which can be joined tightly to the ink-jet face of the head, and a suction pump communicating with the cap. This embodiment further includes a pump driving mechanism capable of driving the suction pump, a motor capable of driving the pump driving mechanism, and a switching gear capable of taking a transfer position where the motive power of the motor is transmitted to the pump driving mechanism and a non-transfer position where the motive power is not transmitted to the pump driving mechanism. An operating projection is fitted to the carriage in a manner capable of moving in a direction intersecting the reciprocating direction of the carriage.

The embodiment of the present invention further includes a changeover holding apparatus which operates to shift the switching gear to one of the transfer and non-transfer positions when the driven portion is brought into contact with the operating projection which holds it in the position thus shifted. The changeover holding device has portions facing into a path through which the operating projection passes and which are thus driven by the operating projection. The path has operating paths where the changeover holding apparatus is actuated when the operating projection enters the path and non-operating paths where the changeover holding apparatus is not actuated even when the operating projection enters those paths.

The ink-jet printer according to the above-described embodiment is capable of cleaning the ink-jet face by reciprocating the carriage in such a way as to bring the ink-jet face in slidable contact with a cleaning device capable of making slidable contact with the ink-jet face of the head. The length of the non-operating path in the reciprocating direction of the carriage is not less than the stroke of reciprocation of the carriage necessary for the cleaning operation.

In order to accomplish the other object described above, an ink-jet printer according to another embodiment of the invention comprises a carriage which reciprocates in a direction perpendicular to a direction in which printing paper is conveyed by a paper conveyor, a head, fitted to the carriage, for printing characters by sending jets of ink from the nozzles formed on an ink-jet face to printing paper, a printing area where characters are printed on printing paper by the head, and a nonprinting area where characters are not printed thereon by the head, the nonprinting area being outside the printing area. The embodiment function comprises a cap, within the nonprinting area, which can be joined tightly to the ink-jet face of the head, a suction pump communicating with the cap, a pump driving mechanism capable of driving the suction pump, and a motor capable of driving the pump driving mechanism.

A switching gear is capable of taking a transfer position where the motive power of the motor is transmitted to the pump driving mechanism and a non-transfer position where the motive power is not transmitted to the pump driving mechanism. An operating projection is fitted to the carriage in a manner capable of moving in a direction intersecting the reciprocating direction of the carriage. A changeover holding device has driven portions facing into the path and operates to shift the switching gear to one of the transfer and non-transfer positions when the driven portion is brought into contact with the operating projection.

The embodiment further includes a movement preventive device for preventing the carriage in a standby position provided on the side of the nonprinting area from moving toward the printing area while no printing operation is performed by the head. The movement preventive device includes a blocking wall which the operating projection contacts and which is provided closer to the printing area than the position of the operating projection in the path while the carriage is in the standby position.

An ink-jet printer according to the above-described embodiment of the invention is such that the path in the ink-jet printer has entry paths through which the operating projection passes when the carriage enters the printing area, and exit paths through which the operating projection passes when the carriage escapes from the nonprinting area into the printing area. The blocking wall is provided close to the end portion of the entry path, and the start portion of the exit path is situated in a position displaced from the end portion and opposite to the printing area.

The cap of the ink-jet printer according to the above-described embodiment is provided with a first opening connected to the suction pump, and a second opening different from the first opening and capable of communicating with the outside atmosphere. A switching valve is connected to the second opening. The cap is movable together with the carriage when the carriage is moved. The switching valve is switched in response to the movement of the carriage so as to cut off communication of the second opening with the atmosphere while the carriage is in the standby position, and to communicate the second opening with the atmosphere when the carriage is moved so that the operating projection is positioned in the start portion of the exit path. The switching gear in the above-described ink-jet printer is also used to transmit the motive power of the motor to the paper conveyor when it is in the non-transfer position where the motive power of the motor is not transmitted to the pump driving mechanism.

The embodiments of the ink-jet printer described above enables the printing paper to be conveyed by the paper conveyor, and jets of ink are sent from the nozzles formed on the ink-jet face fitted to the carriage which reciprocates in a direction perpendicular to the direction in which the printing paper is conveyed.

When the printing operation is not performed for a certain period of time, the cap is tightly joined to the ink-jet face of the head so that ink is prevented from drying up and the nozzles of the head are thus prevented from being clogged with dried ink. If the nozzles become clogged with the dried ink, the function of the head can be recovered by tightly joining the cap to the ink-jet face of the head and forcibly sucking the ink out of the nozzles by the suction pump.

In order to drive the suction pump, the operating projection is made to enter the operating path by moving the carriage. The driven portion of the changeover holding apparatus protrudes in the operating path and the changeover holding apparatus is actuated when the operating projection is brought into contact with the driven portion. As the switching gear is then shifted to the transfer or non-transfer position and held in that position, the operating projection is caused to enter the operating path so that the switching gear is shifted to the transfer position and the suction pump can be driven.

Since the path has the non-operating path where the changeover holding apparatus is not actuated even when the operating projection enters that path, the changeover holding apparatus is not actuated as long as the carriage is moved so that the operating projection passes through only that path after the changeover holding apparatus is actuated once. Therefore, the switching gear is kept on the shifted side.

Hence, with the arrangement above, the carriage is set free to move as long as the operating projection is passed through only the non-operating path after the changeover holding apparatus is actuated and the suction pump can be driven, irrespective of the position of the carriage. Therefore, the freedom of the carriage in the ink-jet printer during the operating of the suction pump is increased.

The ink-jet printer also is capable of cleaning the ink-jet face by reciprocating the carriage in such a manner as to bring the ink-jet face in slidable contact with the cleaning device capable of making slidable contact with the ink-jet face of the head, and the length of the non-operating path in the reciprocating direction of the carriage is not less than the stroke of reciprocation of the carriage necessary for the cleaning operation. Therefore, the cleaning of the ink-jet face can be carried out by reciprocating the carriage in such a way as to make the operating projection pass through only the non-operating path after the changeover holding apparatus is actuated once. Hence, the cleaning operation can be performed while the suction pump is being driven.

When the printing operation is not performed for a certain period of time, the cap is tightly joined to the ink-jet face of the head so that ink is prevented from drying up and the nozzles of the head are thus prevented from being clogged with dried ink. However, if the nozzles are clogged with the dried ink, the function of the head can be recovered by tightly joining the cap to the ink-jet face of the head and forcibly sucking the ink out of the nozzles by the suction pump.

The suction pump can be driven by shifting the switching gear to the transfer position after the carriage is moved so that the switching device is actuated by bringing the operating projection into contact with the driven portion. When the printing operation is not performed by the head, the carriage is moved to the standby position provided in the nonprinting area. The carriage in the standby position is prevented from being moved by the movement preventive device.

Since the movement preventive device includes the blocking wall which can be brought into contact with the operating projection and is provided closer to the printing area than the position of the operating projection in the path while the carriage is in the standby position, a special stopper that is necessary in the typical printer can be eliminated. Accordingly, the number of component parts can be reduced, and the construction is simplified.

Since the blocking wall is provided close to the end portion of the entry passage, and the start portion of the exit path is situated in the position displaced from the end portion and opposite to the printing area, the carriage in the standby position can easily be moved into the printing area by moving the carriage in a direction opposite to the printing area once.

More specifically, the operating projection is positioned in the start portion of the exit path when the carriage in the standby position is moved in a direction opposite to the printing area. As the operating projection is then passed through the exit path, the carriage is allowed to escape from the nonprinting area into the printing area by moving the carriage toward the printing area.

Additionally, the cap in the ink-jet printer is provided with the first opening connected to the suction pump, the second opening different from the first opening and capable of communicating with the air and the switching valve connected to the second opening. The cap is movable together with the carriage when the carriage is moved, and the switching valve is switched in response to the movement of the carriage in such a way as to cut off communication of the second opening with the atmosphere while the carriage is in the standby position and to communicate the second opening with the atmosphere when the carriage is moved so that the operating projection is positioned in the start portion of the exit passage. Therefore, with the adoption of the movement preventive apparatus thus arranged, a favorable capping condition is obtainable in the standby position.

Furthermore, the switching gear in the ink-jet printer is used to transmit the motive power of the motor to the paper conveyor when it is in the non-transfer position where the motive power of the motor is not transmitted to the pump driving mechanism. Therefore, one motor is used for selectively driving the paper conveyor and the suction pump.

DETAILED DESCRIPTION OF THE PREFERRED EMBODIMENTS

Figure 1:
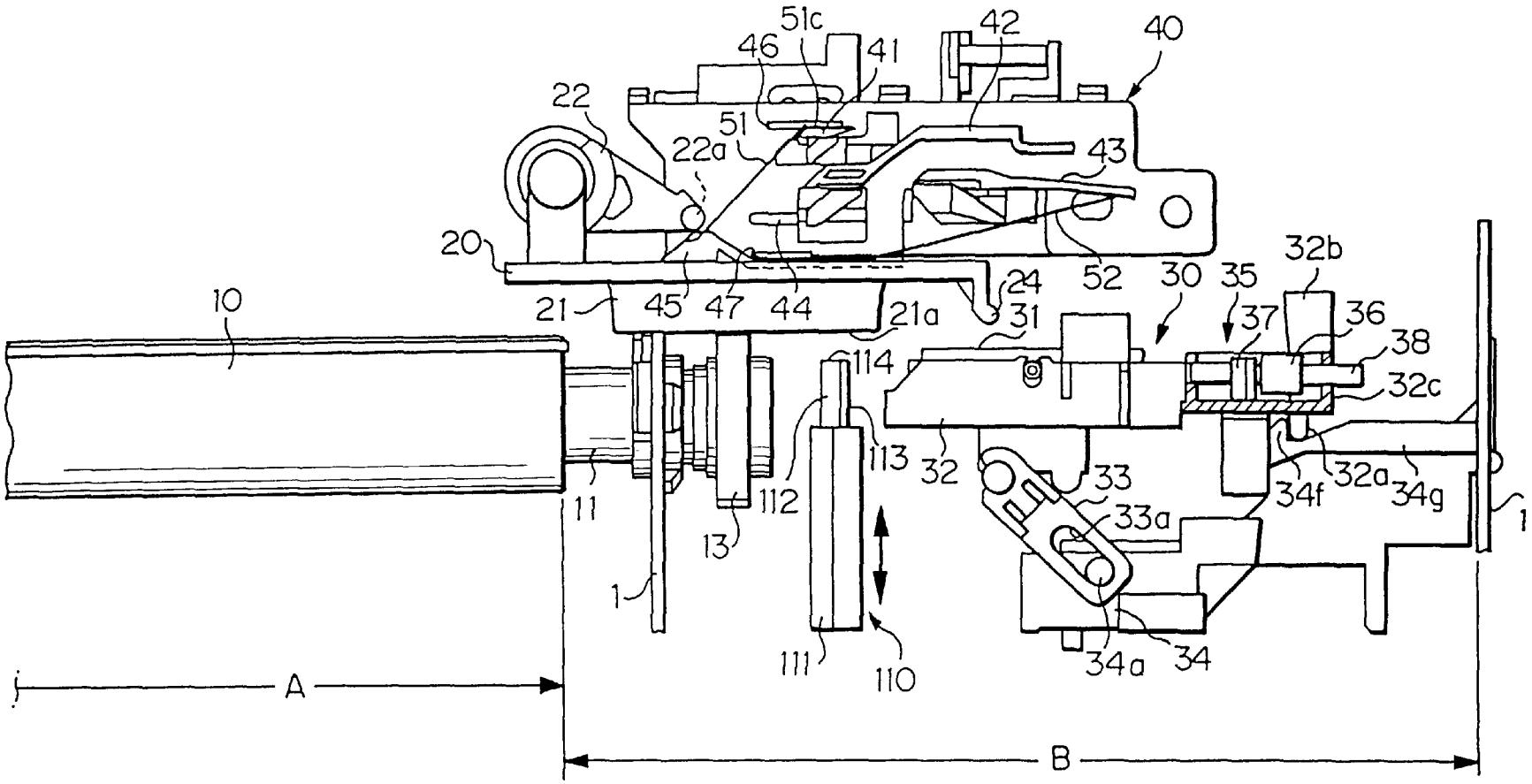
FIG. 1. is a front elevation view showing an embodiment of the present invention.

FIG. 1 is a partial elevational view of an embodiment of an ink-jet printer according to the present invention.

As shown in FIG. 1, a paper conveying roller 10, and a pinch roller (a driven roller) which is forced into contact therewith, forms a paper feeder. Both ends (only the right-hand end is shown in FIG. 1) of the shaft 11 of the paper conveying roller 10 are rotatably supported by a frame 1 of the printer. The shaft is driven by a motor, which is rotated via a gear train as described below. Printing paper, such as copying paper, coated paper, sheets for an overhead projector, gloss paper, gloss films and the like, is conveyed from the rear side to the front side of the roller 10.

A carriage 20 guided by a guiding device having a guide shaft and a guide rail (both not shown) and driven by a carriage motor (not shown) to reciprocate in a direction parallel to the paper conveying roller 10. An ink-jet head 21 (the "head") is mounted on the carriage 20. The head 21 has a nozzle train for making monochromatic printing by jetting out black ink and another nozzle train for making color printing by jetting out ink of a plurality of colors. A monochromatic ink tank and a color ink tank (which are not shown) are disposed on the carriage.

A printing area A is a location where characters are printed on the printing paper or the like by the head 21 fitted to the carriage, and a nonprinting area B is adjacent to and positioned outside of the printing area A and free from the printing operation performed by the head 21.

Figure 2:
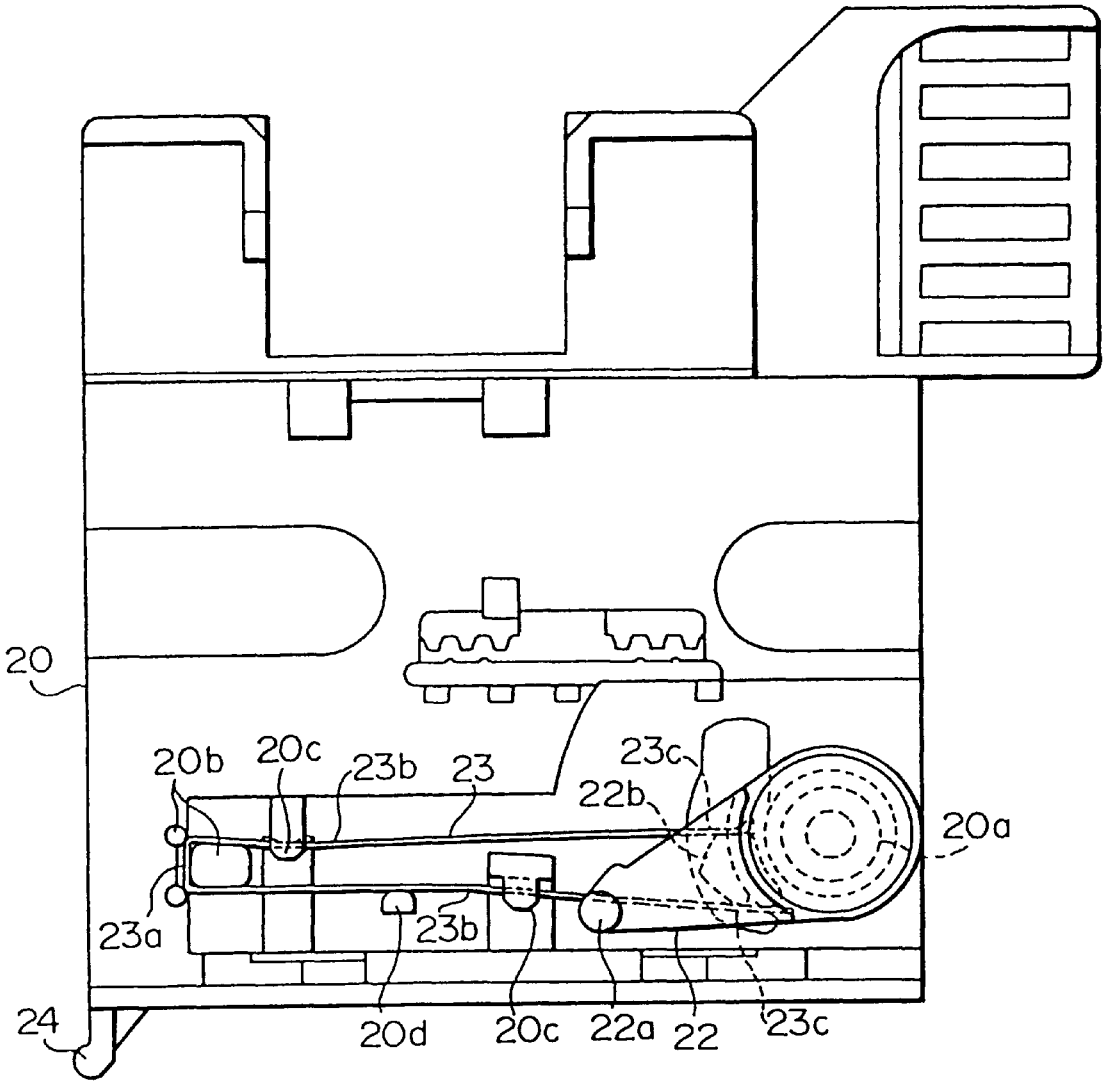
FIG. 2 is a rear elevation view of the carriage of the embodiment shown in FIG. 1.
Figure 5C:
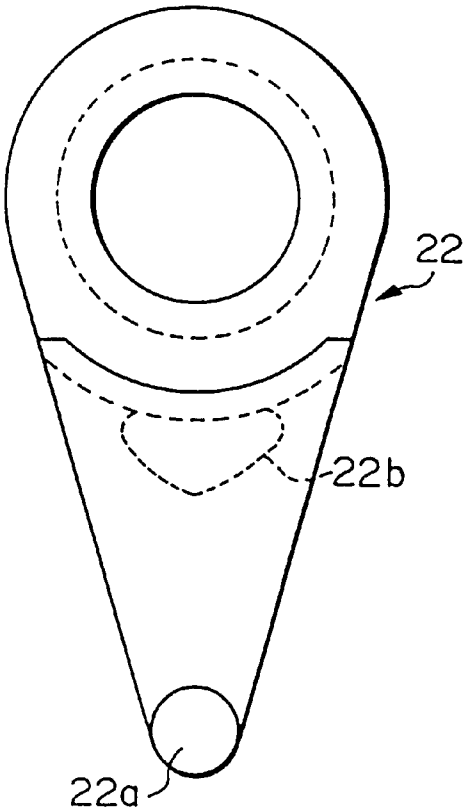
FIGS. 5(*a*)–5(*c*) are front, right side, and rear views, respectively, of the operating lever of the embodiment shown in FIG. 1.
Figure 5B:
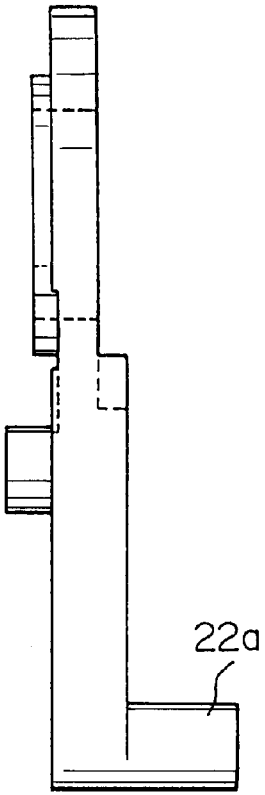
Figure 5A:
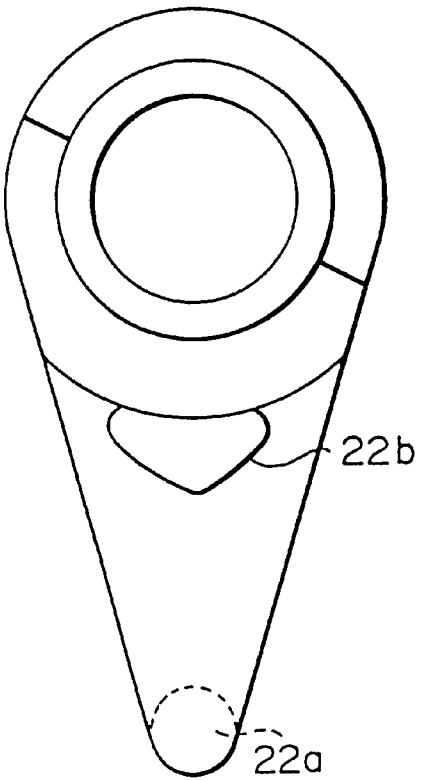

FIG. 2 is a rear elevational view of the carriage 20. An operating lever 22 is rotatably fitted to the rear side of the carriage 20. The operating lever 22 is rotatably supported by a tubular shaft 20*a* formed on the rear side of the carriage and provided with an operating projection 22*a* in its leading end portion, as shown in FIGS. 5(*a*)–5(*c*).

Figure 6A:
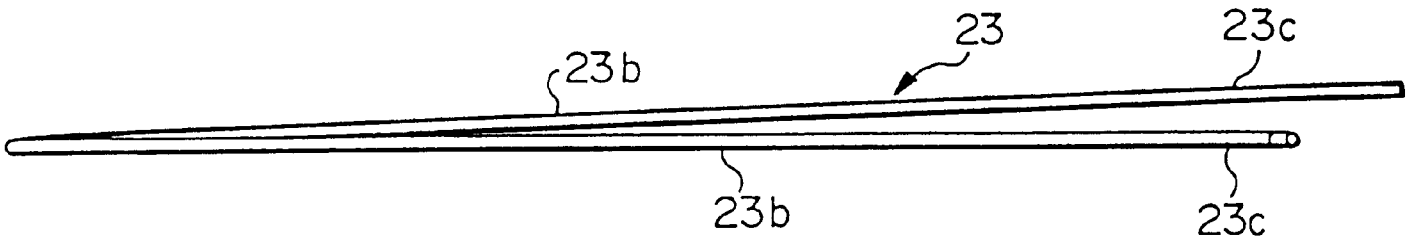
FIGS. 6(*a*)–(*b*) are plan and front views, respectively, of an embodiment of a spring 23 used with the operating lever shown in FIG. 1.
Figure 6B:
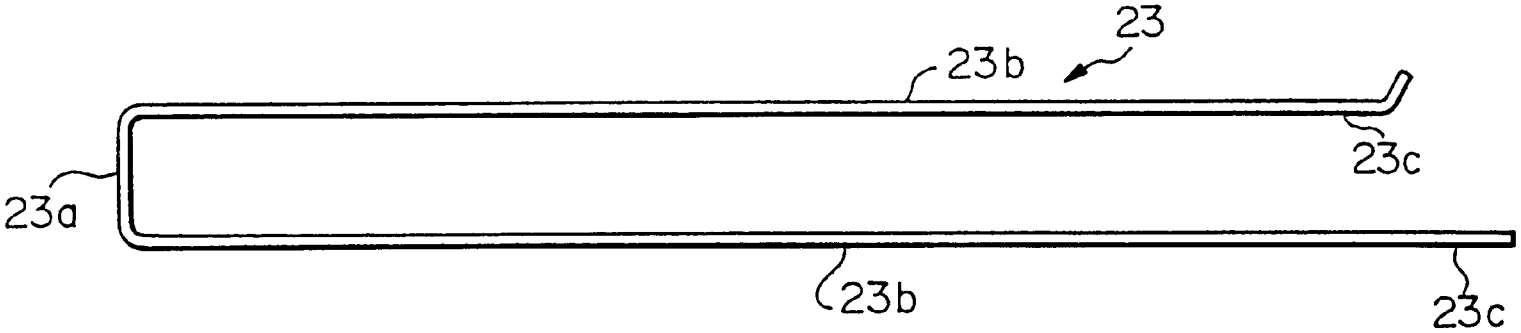
Figure 7A:
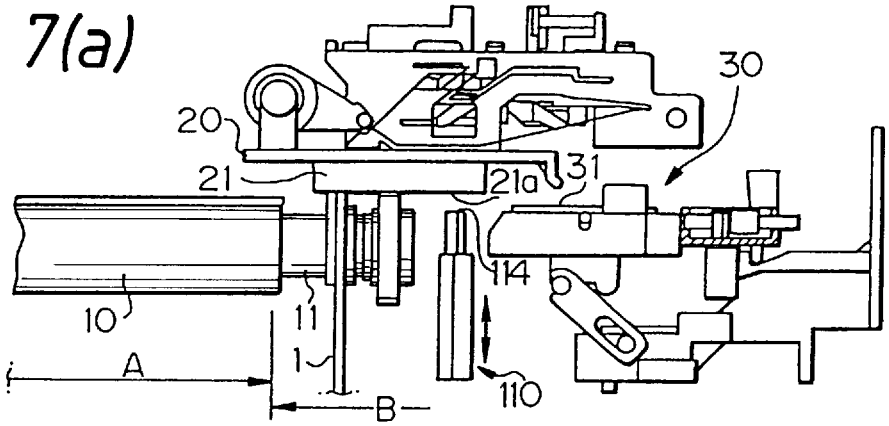
FIGS. 7(*a*)–(*d*) are views exemplifying the movement of an embodiment of a capping unit of the present invention in conjunction with the carriage as shown in FIG. 1.
Figure 7B:
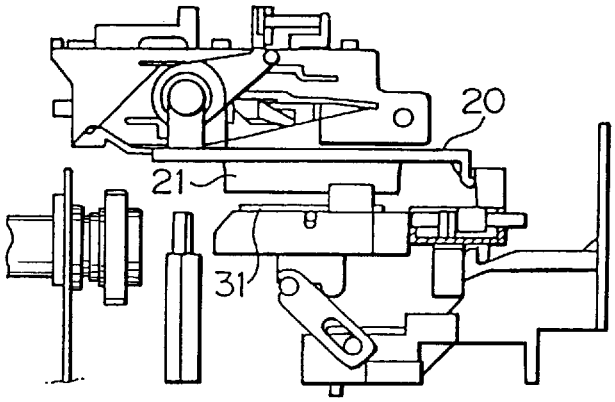
Figure 7C:
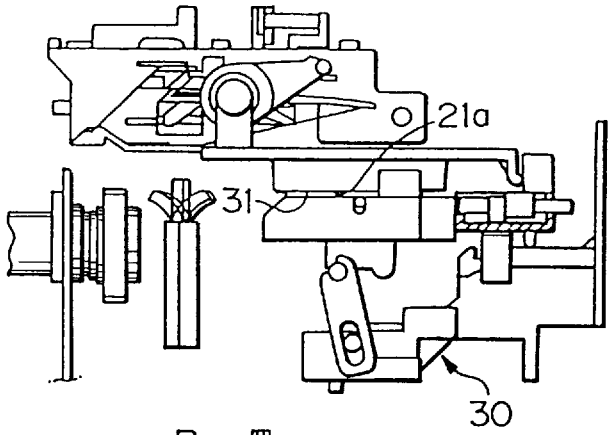
Figure 7D:
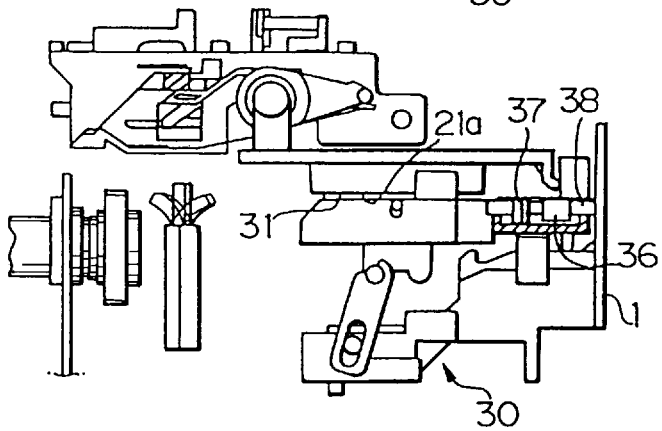

A spring 23, which acts as an urging means, is provided between the operating lever 22 and the rear side of the carriage. The spring 23 keeps a curved shape in a free condition as shown in FIGS. 6(*a*) and 6(*b*), and its bent portion 23*a* is fitted into a lever-holding portion 20*b* as shown in FIG. 2. Further, the intermediate portions 23*b* of the spring 23 engage with respective hook portion 20*c* formed on the rear side of the carriage, and the leading end portions 23*c* thereof are inserted in between the operating lever 22 and the rear side of the carriage, so that the leading end portions are held by the rear side of the carriage. The leading end portions 23*c* are used to clamp a triangular protrusion 22*b* (also see FIGS. 5(*a*)–5(*c*)) formed on the front side of the operating lever 22. The operating lever 22 is thus held in the neutral position (as shown in FIG. 2) unless an external force is applied thereto.

Figure 3:
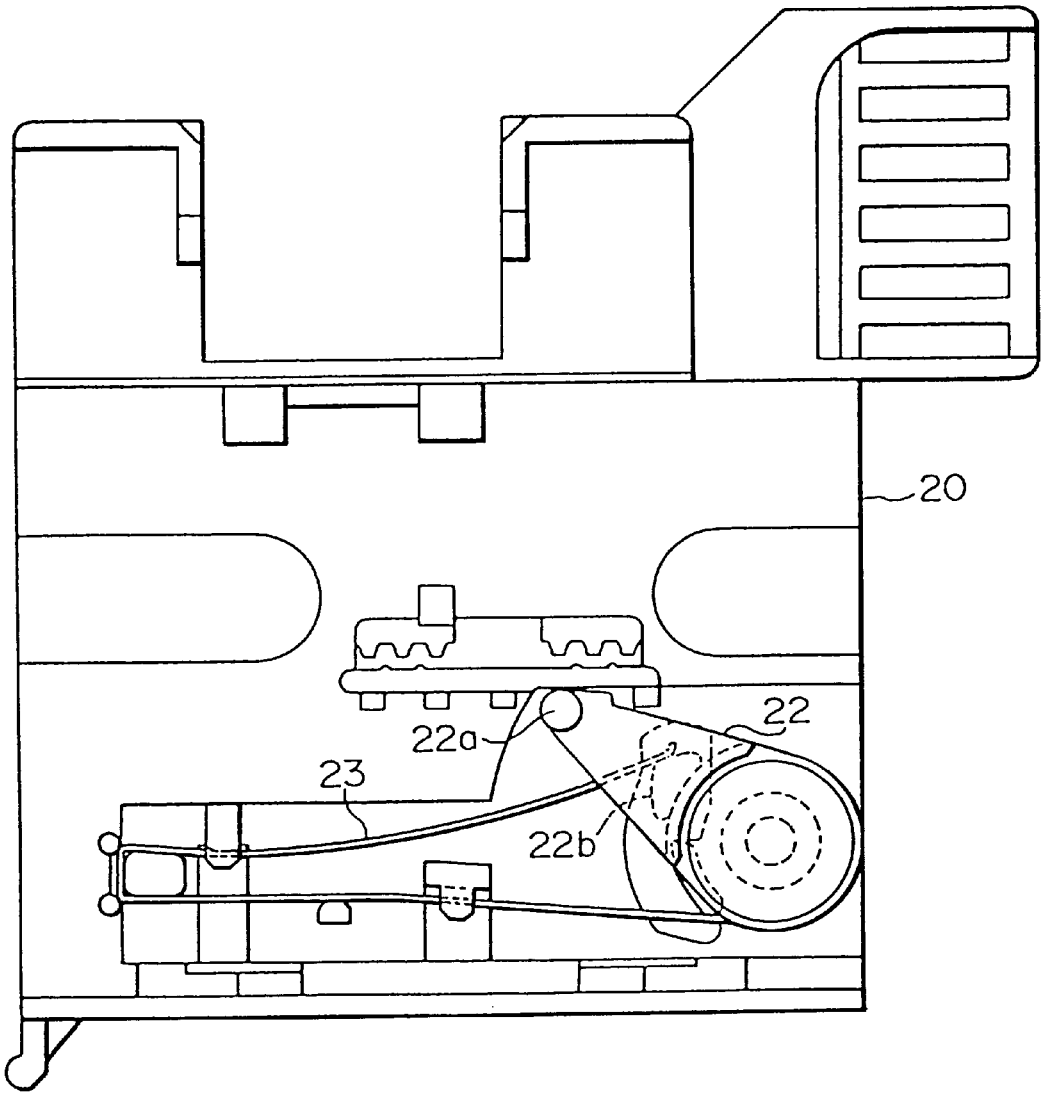
FIG. 3 is another rear elevation of the carriage, as shown in FIG. 2, to illustrate the movement of the operating lever.
Figure 4:
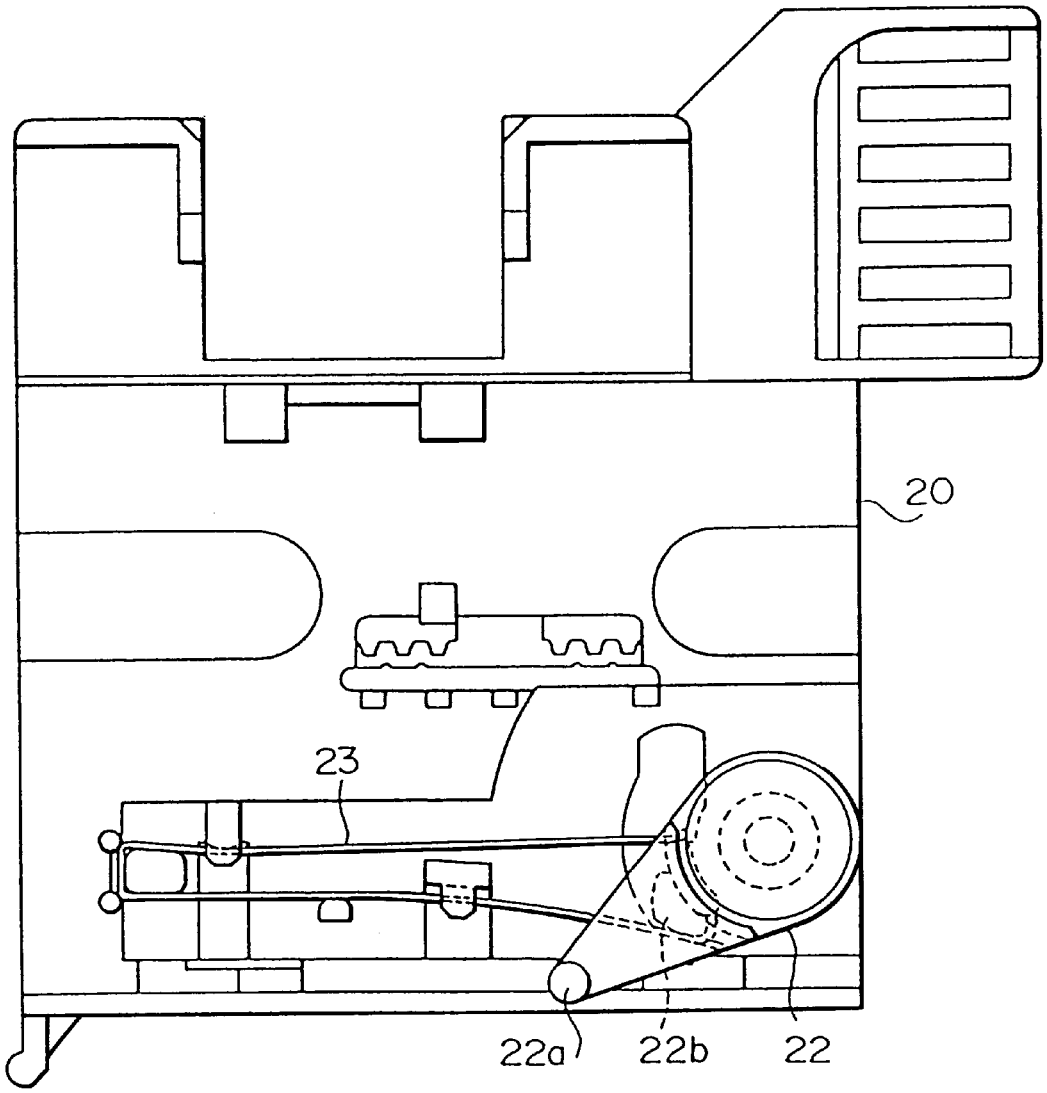
FIG. 4 is a further rear elevation of the carriage, as shown in FIG. 1, to further illustrate the movement of the operating lever.

The operating lever 22 is turned clockwise as shown in FIG. 3, or turned counterclockwise as shown in FIG. 4, when the external force is applied thereto, and, in particular, when the operating projection 22*a* enters a path as the carriage 20 moves, as described below. As a result, the operating projection 22*a* is movable in a direction intersecting the direction in which the carriage reciprocates and is normally urged by the spring 23 toward the neutral position shown in FIG. 2. Further, a support portion 20*d* supports the lower intermediate portion 23*b* of the spring 23 from below.

As further shown in FIG. 1, a capping unit 30 has a cap 31 which is adapted to be tightly joined to the ink-jet face 21*a* of the head 21 from below in order to cover the ink-jet face 21*a* when the carriage 20 stops at the capping position (the position shown in FIG. 7(*c*), which is also known as the standby position) after it has entered the nonprinting area B. The cap 31 is fitted onto a slider 32. Arms 33 (only one is on the side shown in FIG. 1) are used to couple the central or substantially central portion of the slider 32 to a base 34, with the right end of the slider 32 being guided by a guide rail 34*g*.

The arm 33 is rotatably and vertically movably supported with a slit 33*a* provided in its lower portion with respect to the pin 34*a* of the base 34. Further, a compression spring (not shown) for urging the slider 32 in the upper-left direction is installed between the slider 32 and the base 34. The base 34 and guide rail 34*g* are fixed to the frame.

A hook portion 34*f* is formed at the left end of the guide rail 34*g*, so that the leftward movement of the slider 32 is regulated by a projection 32a which is formed at the right end of the slider 32 and engages with the hook portion 34*f*. An upright portion 32*a* is provided on the right end side of the slider 32 and can be brought into contact with a hang-down portion 24 formed at the right end of the carriage 20. A switching valve 35 is incorporated in the slider 32.

Figure 8:
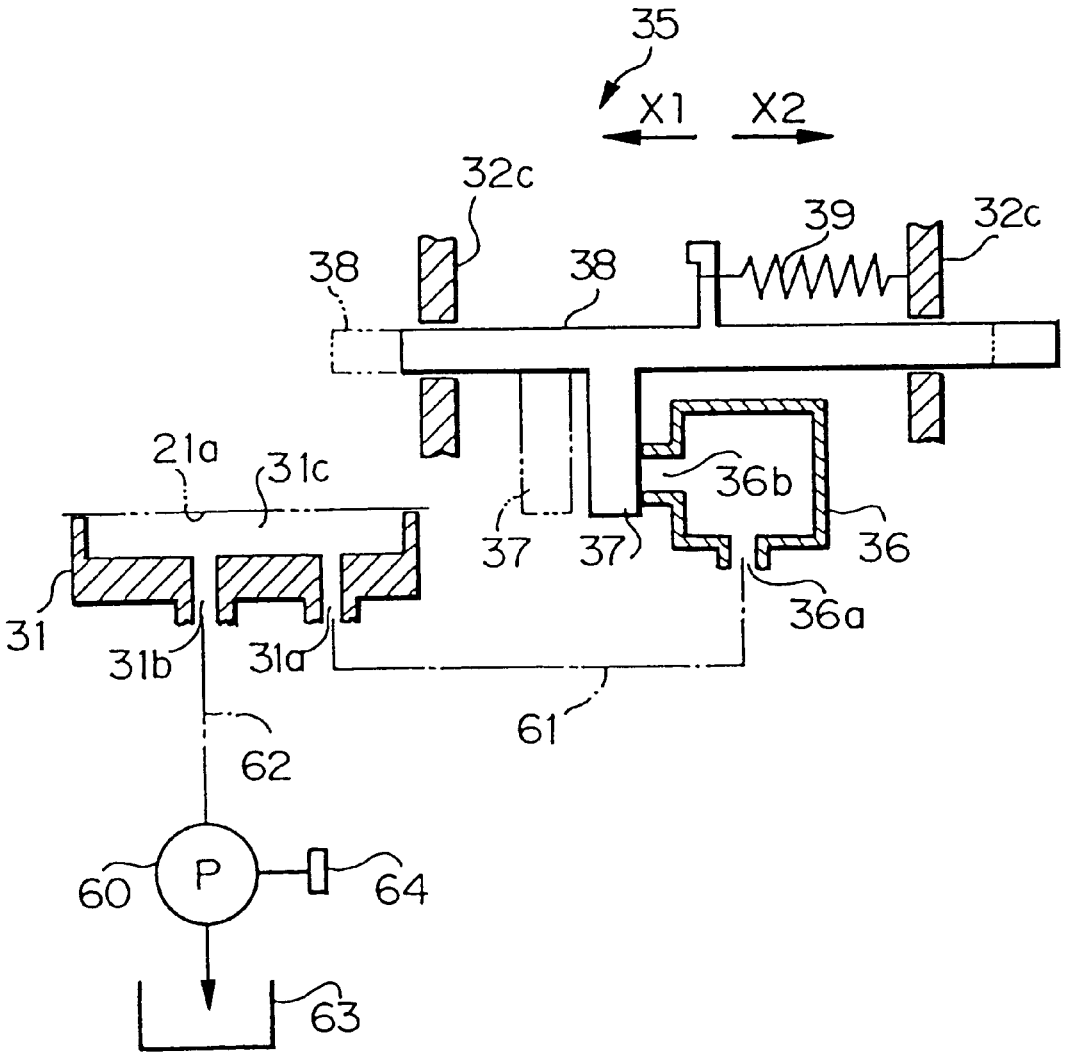
FIG. 8 illustrates an embodiment of an ink suction system in accordance with the present invention.

FIG. 8 is a top view of an exemplary ink suction system including the switching valve 35. As shown in FIGS. 1 and 8, the switching valve 35 includes a valve box 36, a valve element 37 and a valve stem 38. The valve box 36 is fixed to the slider 32 and has two openings 36*a* and 36*b*.

The opening 36*a* is coupled via piping 61 to the second opening 31*a* of the cap 31, and thus, the inner part of the chamber of the valve box 36 communicates with the recess 31*c* of the cap 31. Further, the first opening 31*b* of the cap 31 is coupled via piping 62 to a suction pump 60 (the "pump"). In this case, the recess 31*c* is used to form a space excluding the openings 31*a* and 31*b* when the cap 31 is tightly joined to the ink-jet face 21*a* of the head.

The valve element 37 is used to open and close the opening 36*b*. Further, the pipes 61 and 62 are formed by tubes and/or the like, and the pump 60 is a tube pump and/or the like. The valve element 37 and the valve stem 38 are integral with each other or coupled to each other.

The valve stem 38 is slidably supported with the side wall 32*c* of the slider 32 in the direction of arrows X1 and X2. A spring 39 is provided between the valve stem 38 and the side wall 32*c*, and urges the valve stem 38 and the valve element 37 in the direction of the arrow X2. Therefore, the opening 36*b* is opened when the valve stem 38 and the valve element 37 are slid in the direction of the arrow X1 against the force of the spring 39. However, the opening 36*b* is usually closed by the valve element 37 due to the action of the spring 39.

When the opening 36*b* is closed by the valve element 37 in a state where the cap 31 is tightly joined to the ink-jet face 21*a* of the head as shown by an imaginary line 21*a* in FIG. 8, the recess 31*c* of the cap 31 and the valve box 36 are sealed up. When the pump 60 is driven in this state, ink is therefore forcibly sucked from the nozzles of the head. This is known as a proper suction state.

While the opening 36*b* is kept open, as shown by imaginary lines 37*a* and 38*a*, while the cap 31 has been joined tightly to the ink-jet face 21*a* of the head as shown by the imaginary line 21*a* in FIG. 8, air can flow through the opening 36*b* by driving the pump 60. In other words, since the second opening 31*a* of the cap 31 is open to the air, the ink in the recess 31*c* of the cap 31 is sucked by the pump 60 without ink being newly sucked from the nozzles. This is known as a draining suction state.

When the proper suction operation is carried out, the ink contained in the nozzles of the head are sucked by the pump 60 into the recess 31*c* of the cap 31, and the recess 31*c* becomes filled with the ink. If the cap 31 is removed from the head, for example, by moving the carriage toward the position shown in FIG. 1, it is possible that the interior of the printer will become stained with the ink that spills out of the recess 31*c*. However, this can be prevented by sucking and discharging the ink in the recess 31*c* by preforming the draining suction operation.

In either the proper or draining suction operation, ink from the pump 60 is discharged into a waste ink tank 63. An ink absorption material such as felt, sponge or the like, is disposed in the waste ink tank 63, so that waste ink is absorbed and held in the ink tank 63.

The capping unit 30 and the switching valve 35 described above operate in the following manner.

While characters are being printed on copying paper with the ink being supplied from the head 21 as the carriage 20 reciprocates in the printing area A, the capping unit 30 remains unoperational. As discussed above, a specific nozzle or nozzles may not jet out any ink for a certain period of time depending on the printing pattern. If this condition continues, that (those) nozzle (nozzles) may become clogged with dried ink. Therefore, a flushing operation in which all of the nozzles jet out ink is performed so as to prevent the clogging.

As shown in FIG. 7(*b*), the flushing operation includes the entry of the carriage 20 into the nonprinting area B up to the position where the head 21 is situated opposite to but out of contact with the cap 31. Ink is then jetted out of all of the nozzles toward the recess 31*c* of the cap 31.

Since the ink can overflow the recess 31*c* of the cap 31 after the flushing operation is performed a predetermined number of times, the pump 60 is driven to operate at a point of time the flushing operation has been performed the predetermined number of times so as to suck the ink from the recess 31*c*. In order to suck the ink from the recess 31*c*, it may be sucked by driving the pump 60 in the aforementioned draining suction state or otherwise, in such a state that the cap 31 and the ink-jet face 21*a* of the head remain out of contact with each other.

The hang-down portion 24 of the carriage 20 then contacts the upright portion 32*a* of the slider 32 in the position shown in FIG. 7(*b*). When the carriage 20 is moved from this position to the right further, the capping operation begins.

That is, when the carriage 20 is moved from the position shown in FIG. 7(*b*) to the right, the slider 32 is moved to the right and also moved upward with the rotational operation of the arms 33 since the hang-down portion 24 is kept in contact with the upright portion 32*a* of the slider 32. With the entry of the carriage 20, the cap 31 is moved up toward the head 21 while moving in parallel to the carriage and, as shown in FIG. 7(*c*), it is tightly joined to the ink-jet face 21*a* of the head. The proper or draining suction operations can be carried out in this state.

When the carriage 20 is moved from the position shown in FIG. 7(*c*) to the right further, the slider 32 is also moved to the right further so that the head 21 and the cap 31 are kept in contact with each other. As shown in FIG. 7(*d*), the valve stem 38 of the switching valve 35 contacts the frame 1, and is thus moved in the direction of the arrow X1 of FIG. 8. Then the opening 36*b* of the valve box 36 is opened, so that the draining operation can be performed.

Figure 9:
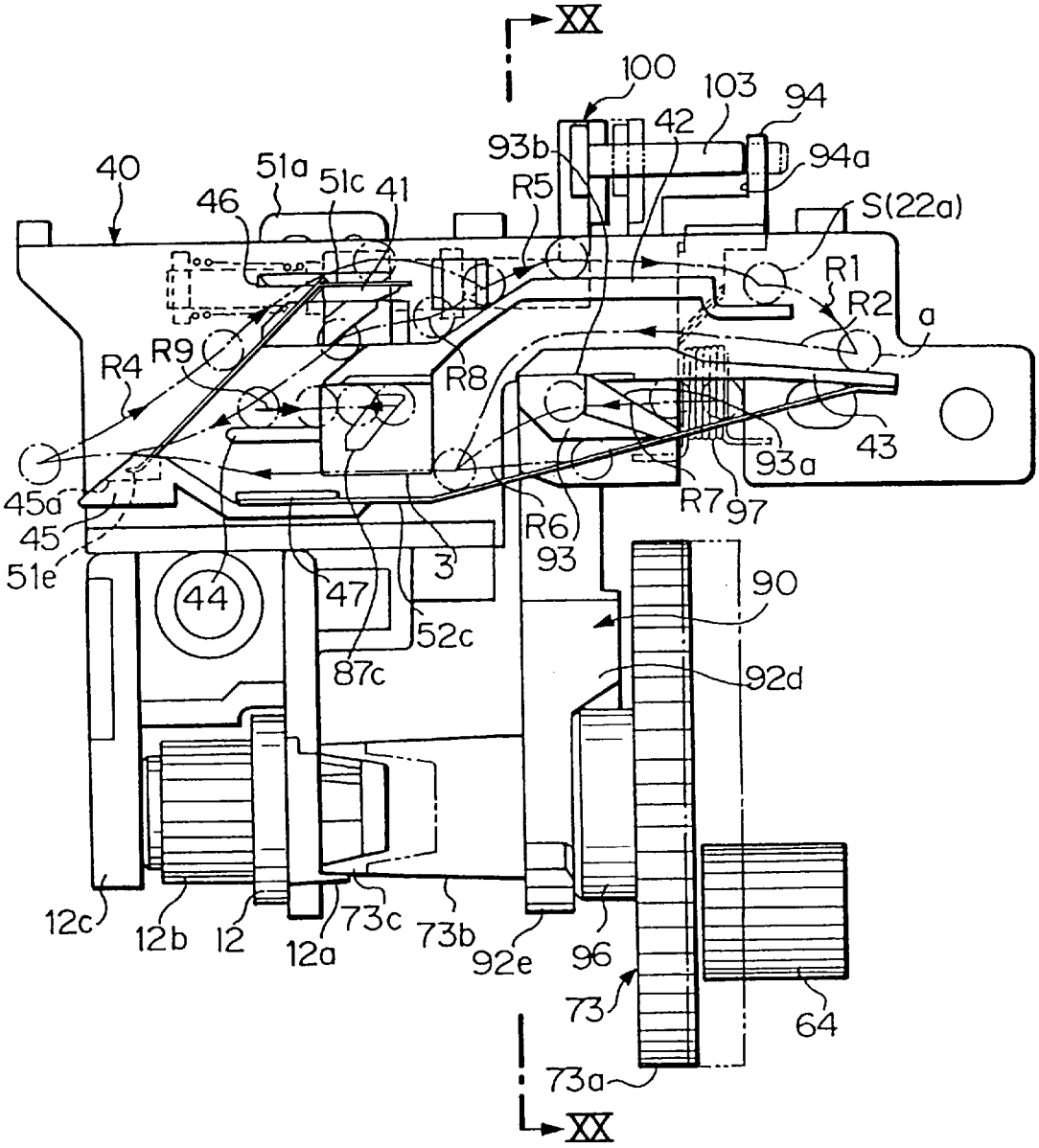
FIG. 9 illustrates an embodiment of a path forming member and a switching lever according to the present invention.
Figure 10:
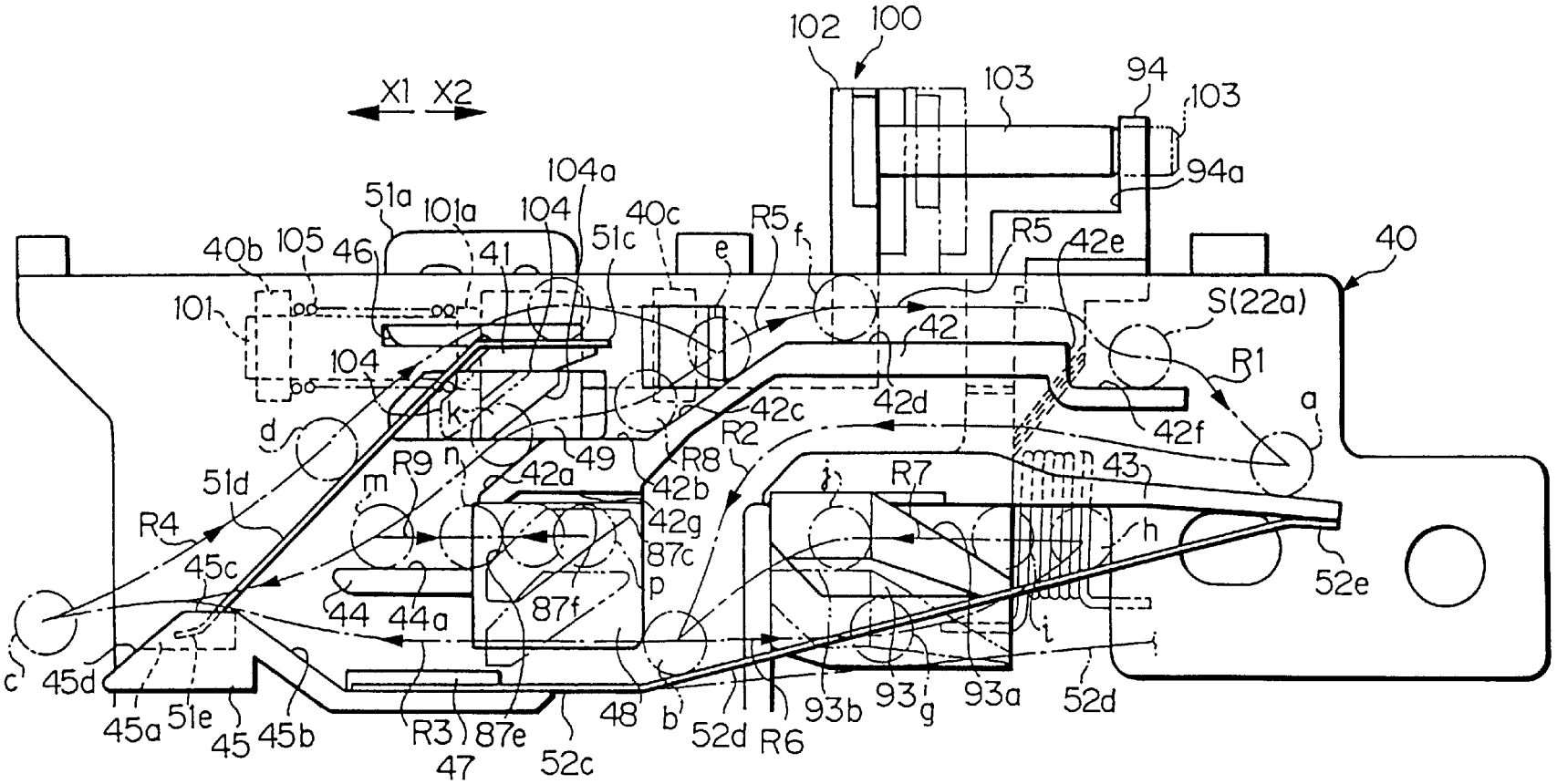
FIG. 10 illustrates movement of an operating projection along the path forming member as shown in FIG. 9.

As shown in FIG. 1, a path forming member 40 forms a path through which the operating projection 22*a* passes, and is fixed to a portion (not shown) of the frame 1. The path forming member 40 is formed, for example, by monolithic molding and, as shown in FIGS. 9 and 10, has a first 41, a second 42, a third 43, a fourth 44 and a fifth partition wall 45 for forming the path. Further, a first plate spring 51 for forming the path is provided between the first partition wall 41 and the left-hand side of the fifth partition wall 45, and a second plate spring 52 is provided between the first partition wall and the right-hand side of the fifth partition wall.

Figure 11A:
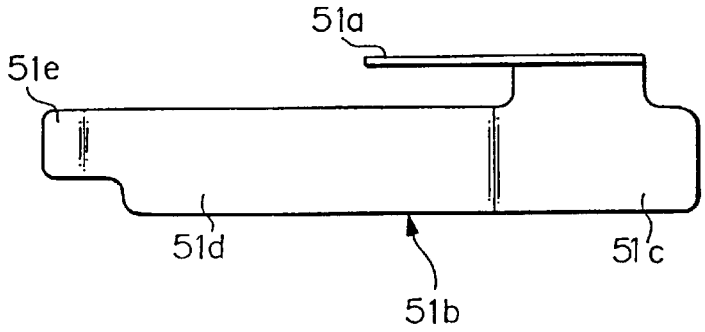
FIGS. 11(*a*)–(*c*) are plan, elevation, and right side views, respectively, of an embodiment of a first plate spring according to the present invention which is employed in the path forming member shown in FIG. 9.
Figure 11B:
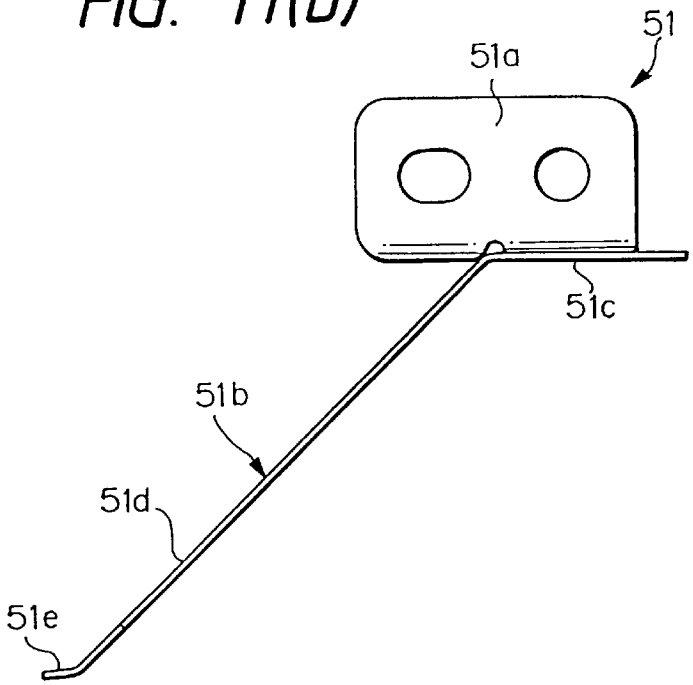
Figure 11C:
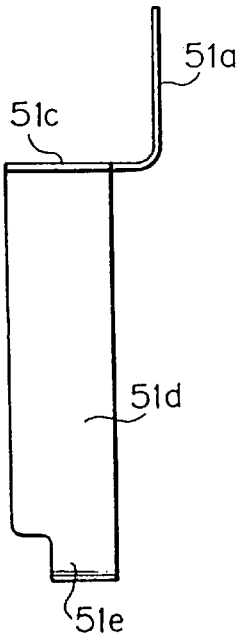

As shown in FIGS. 11(*a*)–11(*c*), the first plate spring 51 has a fitting portion 51*a* and a plate spring portion 51*b* formed integrally with the fitting portion 51*a*. The plate spring portion 51*b* has a horizontal portion 51*c* and a tilted portion 51*d*, with the lower end 51e of the tilted portion 51*d* being slightly bent clockwise with respect to the plate spring portion 51*b*.

The first plate spring 51 is fitted to the path forming member 40 by passing the fitting portion 51*a* through a slit 46 bored in the path forming member 40 from the surface to the rear side of the slit so as to fix the first plate spring to the rear side of the path forming member 40. The horizontal portion 51*c* of the first plate spring is supported by the surface of the first partition wall 41, and the lower end 51*e* is fitted into a groove 45*a* formed in the fifth partition wall 45.

Figure 12A:
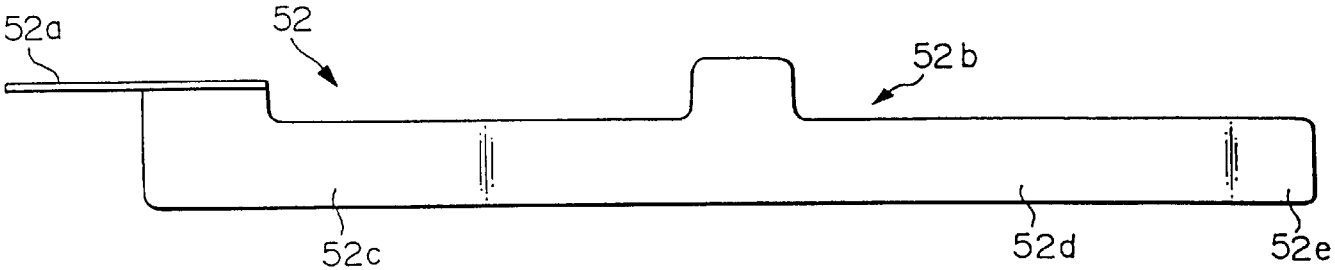
FIGS. 12(*a*)–(*c*) are plan, elevation and left side views, respectively, of an embodiment of a second plate spring according to the present invention which is employed in the path forming member shown in FIG. 9.
Figure 12B:
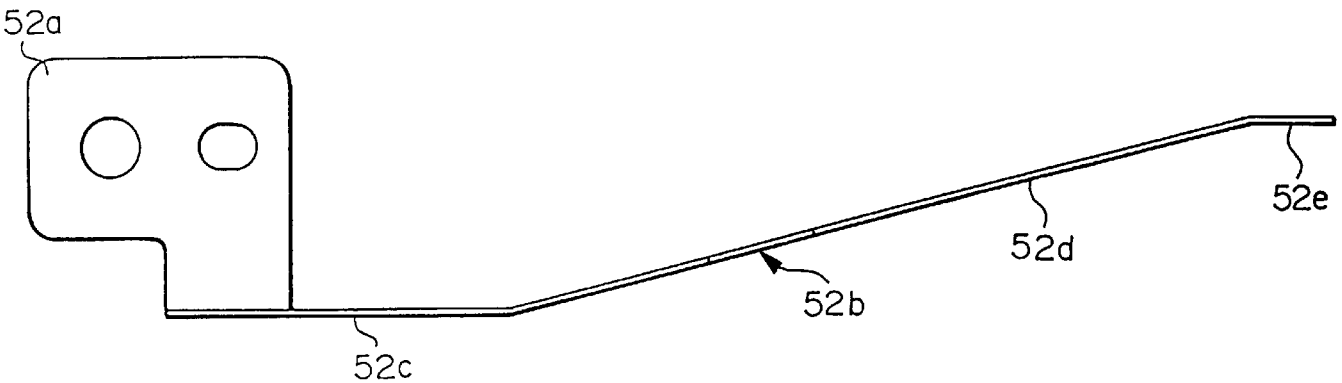
Figure 12C:
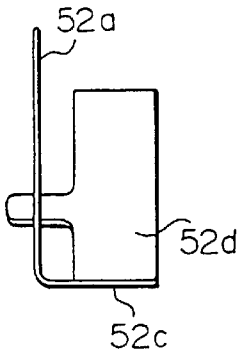

As shown in FIGS. 12(*a*)–12(*c*), the second plate spring 52 has a fitting portion 52*a* and a plate spring portion 52*b* formed integrally with the fitting portion 51*a*. The plate spring portion 52*b* has a horizontal portion 52*c* and a tilted portion 52*d*, with the upper end 52*e* of the tilted portion 52*d* being slightly bent clockwise with respect to the tilted portion 52*d*.

The second plate spring 52 is fitted to the path forming member 40 by passing the fitting portion 52*a* through a slit 47 bored in the path forming member 40 from the surface to the rear side of the slit so as to fix the second plate spring to the rear side of the path forming member 40. The horizontal portion 52*c* of the second plate spring is supported by the surface of the fifth partition wall 45, and the upper end 52*e* contacts the right-end underside of the third partition wall 43.

As shown in FIG. 10, the second partition wall 42 has a series of a first tilted face 42*a*, a first horizontal face 42*b*, a second tilted face 42*c*, a second horizontal face 42*d*, a vertical face 42*e* and a third horizontal face 42*f* ranging on the surface thereof leftward. When the carriage 20 is in the position shown in FIG. 7(*c*), that is, in the capping position and also the standby position (also called the home position), the operating projection 22*a* is positioned on the third horizontal face 42*f* as shown by an imaginary line S in FIG. 10.

A description will now be given of a path through which the operating projection 22*a* passes with the position s as a starting point, wherein reference symbols R1–R9 represent the paths of travel of the operating projection 22*a*, and "a" through "p" and "s" represent the positions of the operating projection 22*a*. Further, the operating projection 22*a* is movable in a direction intersecting the direction in which the carriage 20 reciprocates and usually urged by the spring 23 toward the neutral position shown in FIG. 2. Since the neutral position corresponds to the position c in FIG. 10, the operating projection 22*a* is urged downward when it is positioned above c, whereas it is urged upward when it is positioned under c.

As further shown in FIG. 10, when the carriage 20 is moved from the position shown in FIG. 7(*c*) to the right first, the operating projection 22*a* passes through the path R1 and reaches a position a. When the carriage 20 is then moved to the left, the operating projection 22*a* passes through the path R2 and reaches a position b.

If the carriage 20 then continues to move to the left further, the operating projection 22*a* passes through the path R3 and reaches a position c, which corresponds to the neutral position of the operating projection 22*a* as described above with reference to FIG. 2. If the carriage 20 continues to move to the left still further, the carriage 20 moves out of the nonprinting area B (see FIG. 1) and enters the printing area A. In other words, the paths R2 and R3 form an exit passage through which the operating projection 22*a* passes when the carriage 20 moves out from the nonprinting area B into the printing area A.

Incidentally, the path R2 is mainly formed with the surface of the third partition wall 43, whereas the path R3 is mainly formed with the second plate spring 52, the first tilted face 45*b* of the fifth partition wall 45 and the horizontal face 45*c*. The operating projection 22*a* contacts the first plate spring 51 when it climbs up the first tilted face 45*b* of the fifth partition wall 45 in the course of reaching position c from position b. At this time, the operating projection 22*a* bends the tilted portion 51*d* of the first plate spring 51 clockwise and then passes the lower end of that portion.

When the carriage 20 enters the nonprinting area B from the printing area A, the operating projection 22*a* passes through the path R4 via the position c and reaches position e. The path R4 is mainly formed with the second tilted face 45*d* of the partition wall 45, the horizontal face 45*c*, and the first plate spring 51. When the operating projection 22*a* climbs up the tilted portion 51*d* of the first plate spring 51, it tries to turn the first plate spring 51 counterclockwise. However, the first plate spring 51 is not turned since the lower end of the first plate spring 51 is brought into contact with the fifth partition wall 45 to ensure that the operating projection 22*a* passes through the path R4.

When the carriage 20 is moved to the right further, the operating projection 22*a* passes through path R5 from position e and reaches the position s, that is, the home position (standby position). Path R5 is mainly formed with the second horizontal face 42*d* of the second partition wall 42, the vertical face 42*e*, and the third horizontal face 42*f*. In other words, the paths R4 and R5 form an entry passage through which the operating projection 22*a* passes when the carriage 20 moves out from the printing area A into the nonprinting area B.

The vertical face 42*e* is situated close to the end portion of the path R5 (i.e., close to the end portion of the entry path) so as to form a blocking wall. The blocking wall 42*e* is provided on the side of the printing area A from the position s where the operating projection 22*a* is positioned while the carriage 20 is in the standby position. When the carriage 20 attempts to move to the left from the standby position, the blocking wall 42*e* comes in contact with the operating projection 22*a* and blocks the leftward movement of the carriage 20. In other words, blocking wall 42*e* and operating projection 22*a* act as a movement preventive means for preventing the carriage 20 in the standby position provided on the side of the nonprinting area B from moving toward the printing area A while no printing operation is performed.

The position s of the operating projection 22*a* is in a position up from the neutral position c when the operating lever 22 has been turned clockwise against the force of the spring 23 as shown in FIG. 3. Therefore, the operating projection 22*a* at the position s has been urged downward by the force of the spring 23 so as to contact the third horizontal face 42*f*. When the carriage 20 attempts to move to the left from the standby position, the operating projection 22*a* comes in contact with the blocking wall 42*e* to ensure that the leftward movement of the carriage 20 is blocked. In this case, the rightward movement of the carriage 20 in the standby position is restrained by the force of the compression spring which is urging the slider 32 upward and leftward as described above.

In order to move the carriage 20 from the nonprinting area B toward the printing area A, the driving force of the carriage motor, which is capable of overcoming the urging force of the compression spring, is used. The operating projection 22*a* is moved from the position s through the path R1 and reaches position a. Since position a corresponds to the start portion of the path R2, that is, the start portion of the exit path, the carriage 20 can be moved into the printing area A by moving the carriage 20 to the left.

The closed-loop paths R1-R5 described above form non-operating paths where no switching means nor changeover holding means is actuated, as will be described below.

The operating path has a pump operating path for use in shifting a switching gear, which will be described later, to the side of a pump driving mechanism by actuating the changeover holding means, and a paper-feeding-means operating path for use in shifting the switching gear to a non-transfer position (to the side of the paper feeding means in this embodiment) also by actuating the changeover holding means.

The pump operating path is formed by paths R6 and R7 branching off from between the paths R2 and R3 at position b. A first driven portion 93, which will be described later, faces a path R7.

The paper-feeding-means operating path is formed with a path R8 branching off from between the paths R4 and R5 at position e. A second driven portion 104 faces the path R8.

In this embodiment, path R9 is provided for operating an automatic paper feeding unit.

The gear train of the printer according to this embodiment will now be described first.

Figure 13:
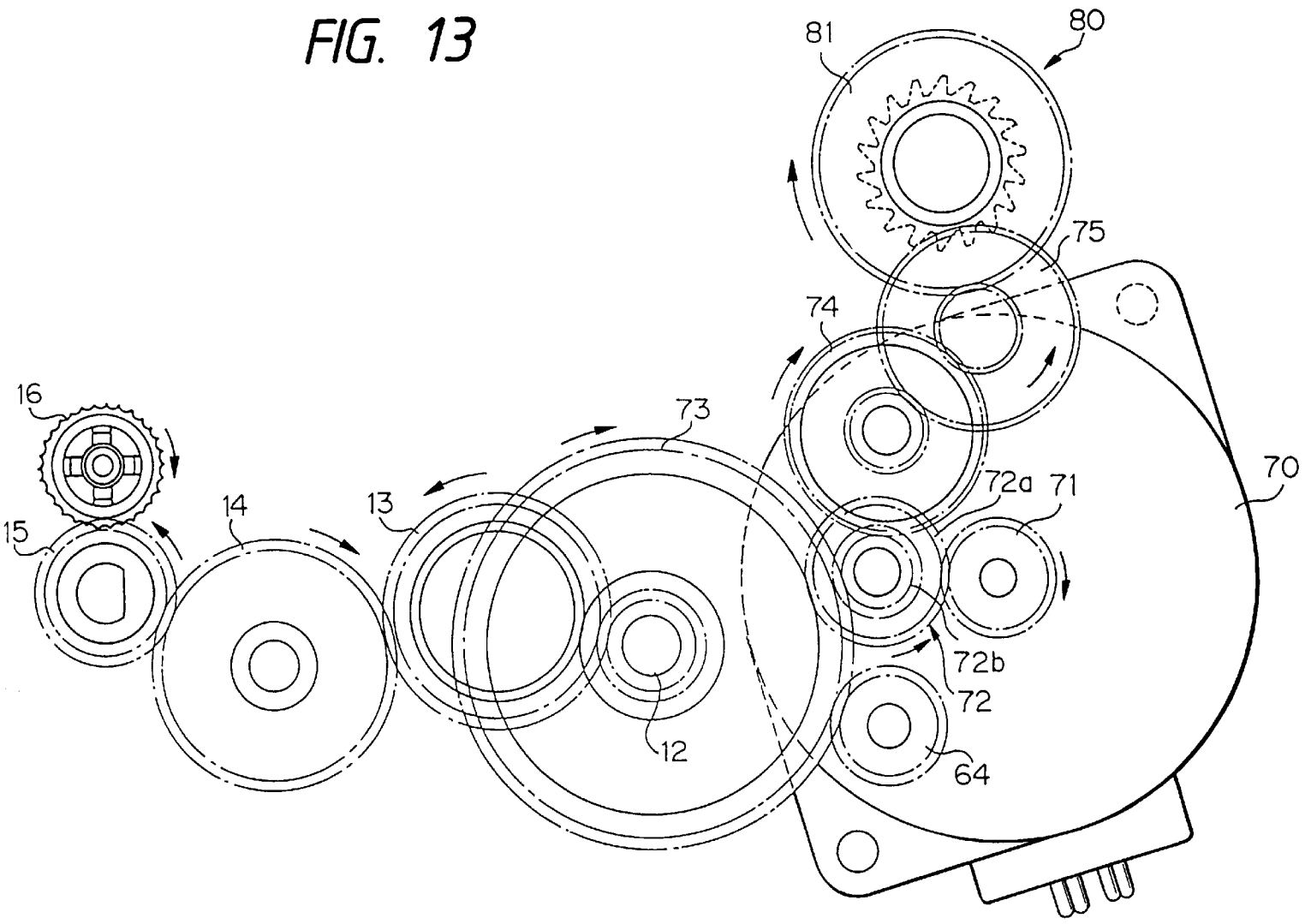
FIG. 13 is a right side view illustrating an embodiment of a gear train of a paper conveying system according to the present invention.
Figure 14:
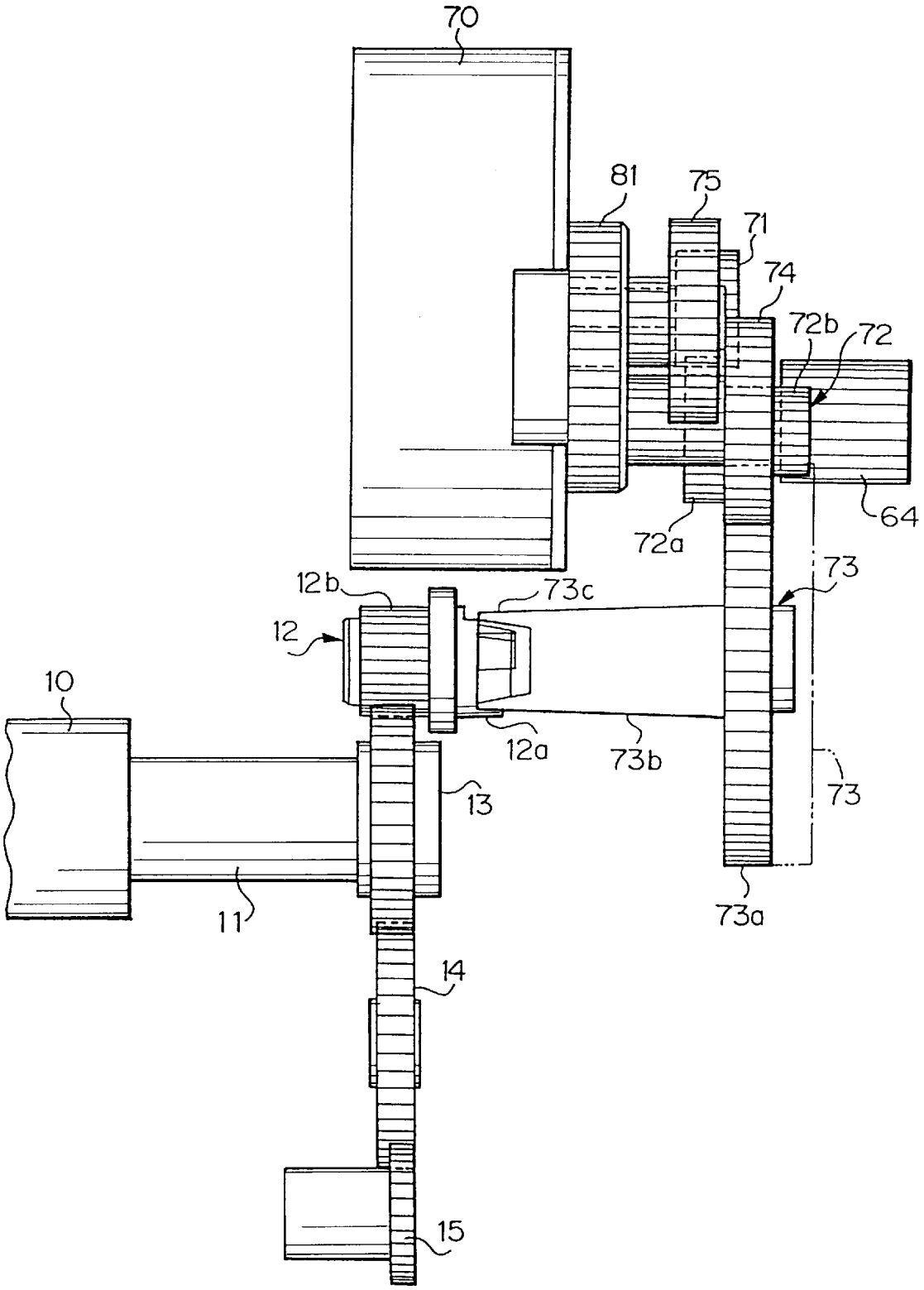
FIG. 14 is a plan view of the gear train shown in FIG. 13.

FIG. 13 is a right side view mainly showing the gear train of a paper conveying system. FIG. 14 is a plan view of the gear train, and FIG. 15 is an elevational view thereof.

Figure 15:
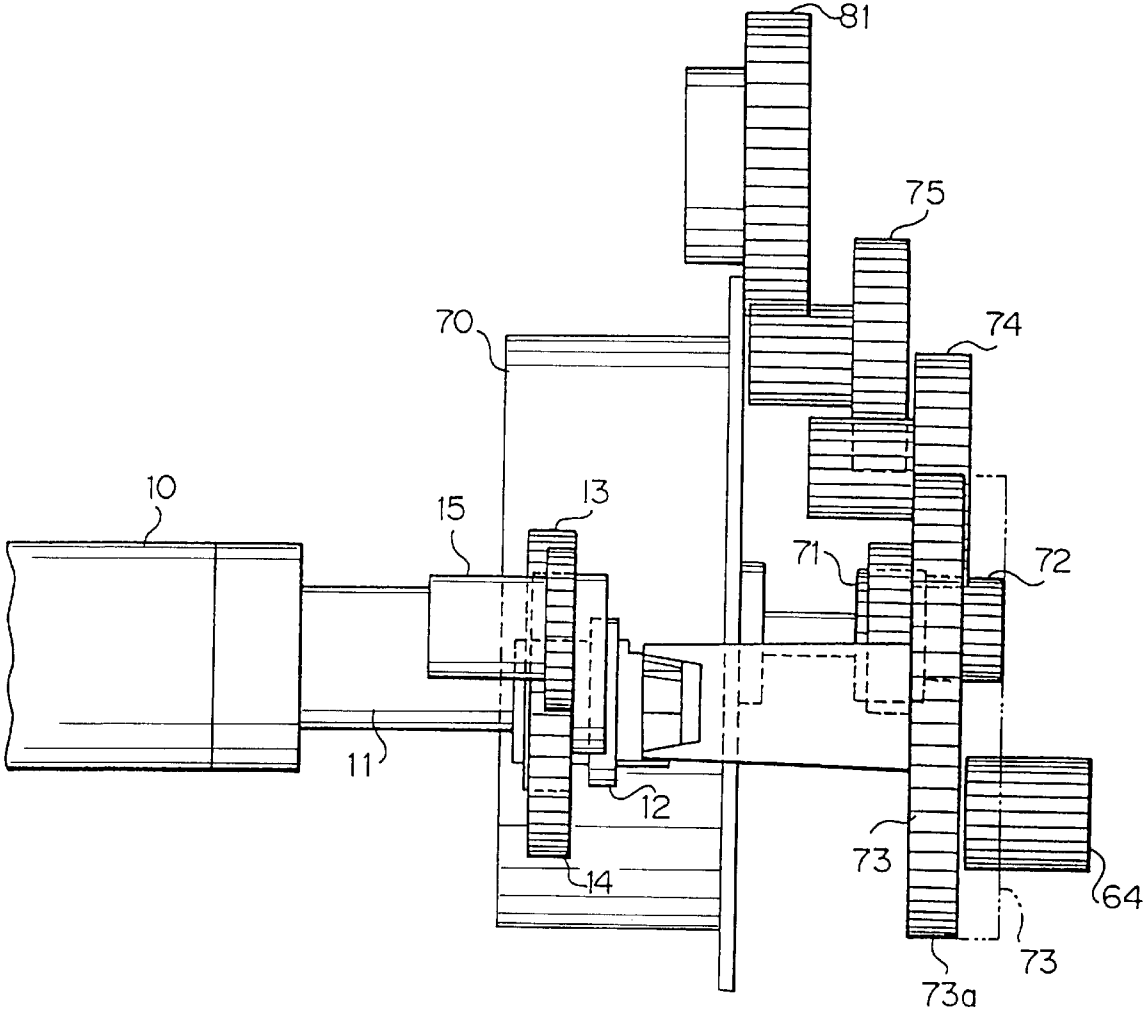
FIG. 15 is an elevation view of the gear train shown in FIG. 13.

As shown in FIGS. 13 to 15, the paper conveying system includes a motor whose output shaft is fixedly fitted with a pinion 71. A main transmission gear 72 has a large gear portion 72*a* that engages with the pinion 71, and a small gear portion 72*b* integral with the large gear portion 72*a*. The small gear portion 72*b* engages with a switching gear 73.

As shown in FIG. 14, the switching gear 73 has a spur gear portion 73*a* engaging with the small gear portion 72*b*, a tubular portion 73*b* integral with the spur gear portion 73*a*, and a pawl portion 73*c* formed at the left end of the tubular portion 73*b*. The switching gear 73 is supported by a shaft (not shown) passed through the tubular portion 73*b* so that it is laterally slidable as shown in FIGS. 14 and 15.

In FIGS. 14 and 15, the position shown by a solid line indicates the switching gear 73 that has been slid to the left. In this state, the pawl 73*c* engages with a gear 12, and the motive power of the motor 70 is thus transmitted to the paper conveying roller 10. On the other hand, the position shown by an imaginary line indicates that the switching gear 73 has been slid to the right. In this state, the pawl 73*c* disengage with the gear 12, and the spur gear portion 73*a* engages with a pump driving gear 64 which forms a pump driving mechanism so that the motive power of the motor 70 is transmitted to the pump 60 (see FIG. 8).

More specifically, the position shown by the imaginary line is a position where the motive power is transmitted to the pump driving mechanism, and the position shown by the solid line is a position where the motive power is not transmitted, that is, a position where the motive power of the motor 70 is transmitted to the paper feeding means. Although the switching gear 73 is usually urged to the left by an urging means (e.g., a compression spring, not shown) to engage with the gear 12, it is allowed to engage with the pump driving gear 64 when slid to the right by the switching means as will be described later.

The gear 12 has a pawl portion 12*a*, which engages and disengages with the pawl portion 73*c* of the switching gear 73, and a spur gear portion 12*b*. As the spur gear portion 12*b* becomes engaged with a gear 13 fixed to a paper conveying roller shaft 11, the paper conveying roller 10 can be driven. The gear 13 is used to transmit the motive power via a gear 14 to a gear 15. The gear 15 is fixed to the end of a paper discharging roller shaft (not shown), whereby a paper discharging roller is driven to rotate. A thin-plate-like star wheel 16 rotates while in contact with the discharging roller and is also brought in contact with a printed surface of printing paper so as to press the paper against the discharging roller. The small gear portion 72*b* of the main transmission gear 72 becomes engaged with a reduction gear 74 and used to transmit motive power via a reduction gear 75 to one-revolution clutch 80 for driving the paper feeding roller shaft of the automatic paper feeding unit.

Figure 16:
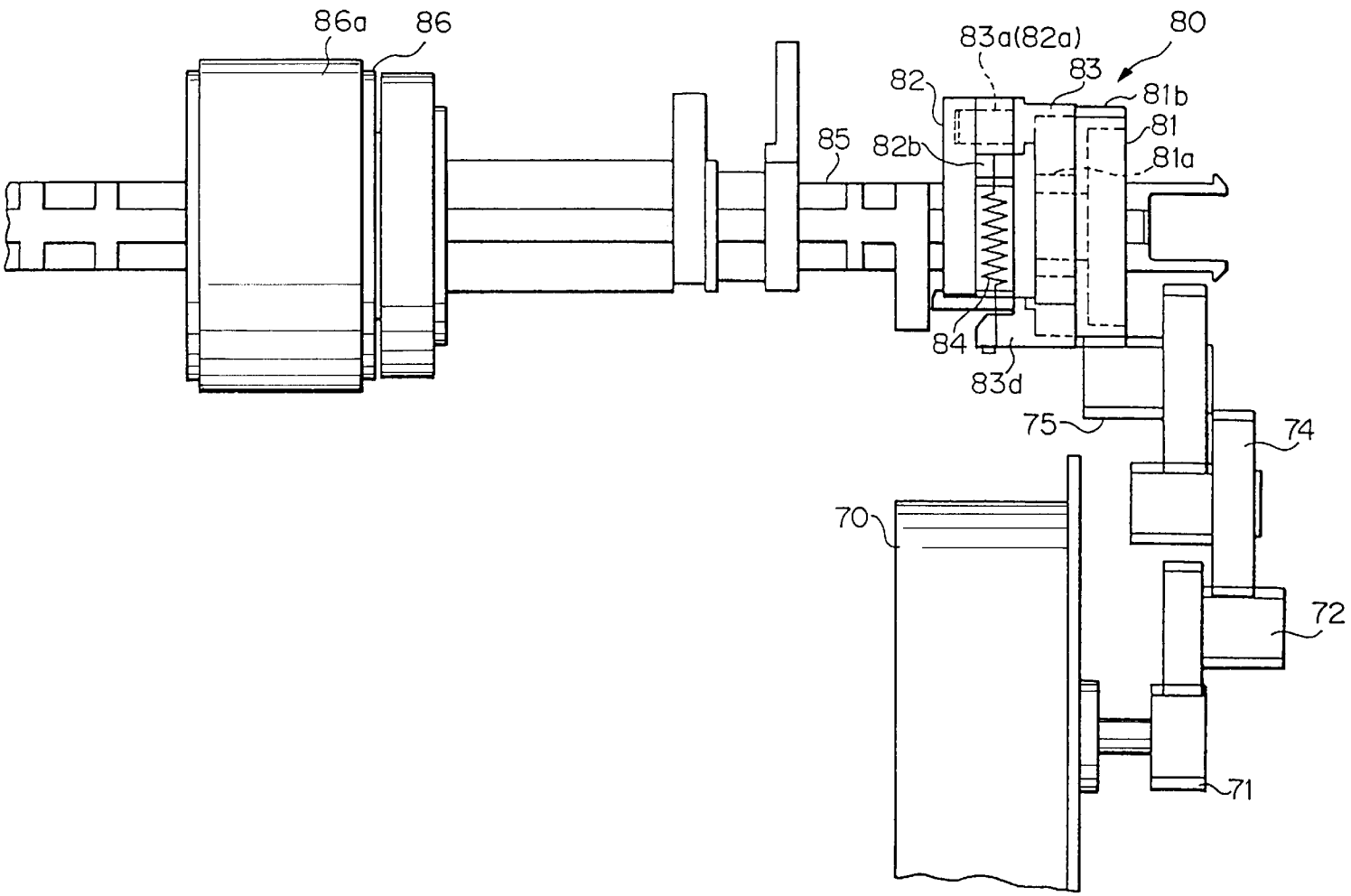
FIG. 16 is a plan view illustrating an embodiment of a one-revolution clutch according to the present invention.
Figure 17A:
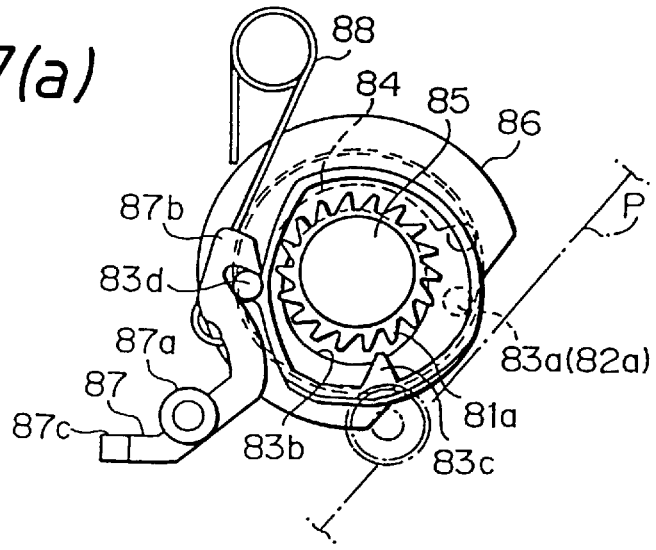
FIGS. 17(*a*)–(*c*) are right-hand side perspective views illustrating the operation of the one-revolution clutch shown in FIG. 16.
Figure 17B:
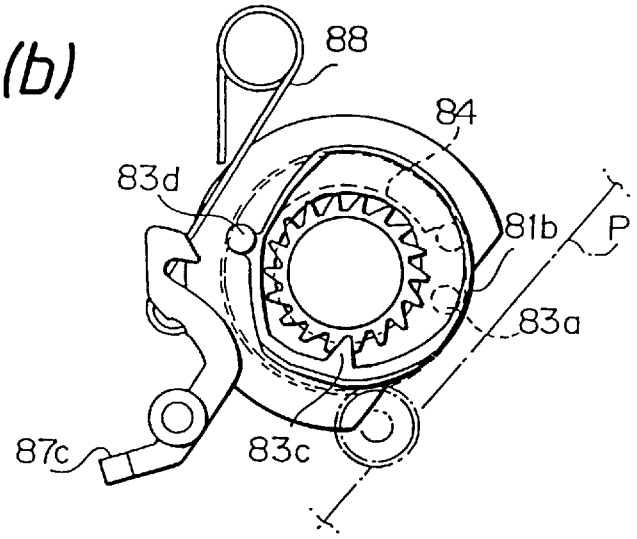
Figure 17C:
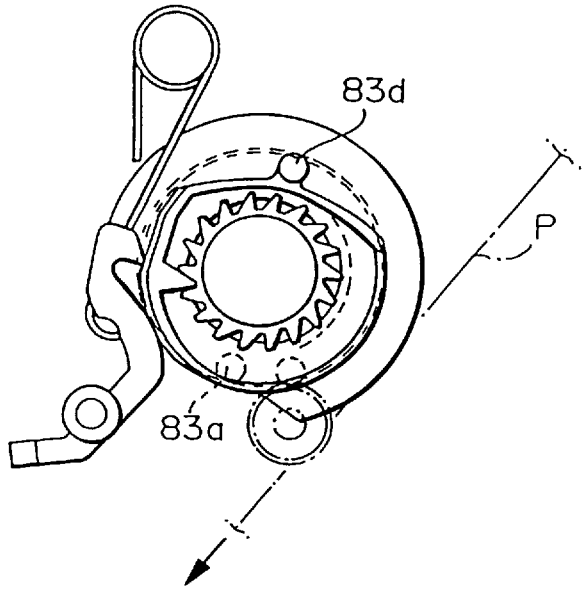

FIG. 16 is a plan view mainly showing the one-revolution clutch 80, and FIGS. 17(*a*)–(*c*) provide a right-hand side perspective view illustrating the operation of the one-revolution clutch 80. Incidentally, FIG. 16 is a plan view showing an exploded gear train.

As shown in FIGS. 16–17(*c*), a paper feeding roller shaft 85 is integral with or coupled to a paper feeding roller 86. The paper feeding roller 86 is D-shaped in profile and has a rubber surface layer 86*a*. There are provided two paper feeding rollers 86 on the paper feeding roller shaft 85. The one-revolution clutch 80 is provided at the right end of the paper feeding roller shaft 85.

The one-revolution clutch 80 has a ratchet wheel 81 rotatably supported with the paper feeding roller shaft 85, a support member 82 coupled to or integrally formed with the paper feeding roller shaft 85, and a swing member 83 supported so that it is capable of swinging with respect to the support member 82 between the support member 82 and the rachet wheel 81.

The rachet wheel 81 has a number of rachets 81*a* on the left-hand side of FIG. 16. The gear portion 81*b* of the rachet wheel 81 becomes engaged with the reduction gear 75. Therefore, the rachet wheel 81 is driven by the motor 70 to rotate simultaneously with the paper conveying roller 10 in a reverse direction via the pinion 71 and the reduction gears 74 and 75 (see FIG. 13).

The swing member 83 has a shaft 83*a*, which is rotatably fitted into the bearing hole of the support member 82 and it is capable of swinging with respect to the support member 82. As the swing member 83 and the support member 82 are coupled together by the shaft 83*a*, these members rotate together around the paper feeding roller shaft 85. The swing member 83 is substantially in the form of a ring having a swing regulating hole 83*b* in its center as shown in FIGS. 17(*a*)–17-(*c*) and is capable of swinging with respect to the support member 82 within a range where the inner edge portion of the swing regulating hole 83*b* makes contact with the paper feeding roller shaft 85. Further, the swing member 83 has a pawl portion 86*c* in its inner peripheral face and a pin-shaped portion to be regulated (hereinafter called the "pin") on its outer peripheral face. The pawl portion 86*c* is detachable from the pawl 81*a* of the rachet wheel 81 and the movement of the pin 83*d* is regulated by a lever 87 as will be described later.

A tension spring 84 is provided between the pin 83*d* of the swing member 83 and the retaining portion 82*b* (see FIG. 16) of the support member 82, so that the swing member 83 is urged in a direction in which the pawl portion 86*c* of the swing member 83 engages with the pawl 81*a* of the rachet wheel 81.

As shown in FIGS. 17(*a*)–17(*c*), a lever 87 actuates the one-revolution clutch 80, and is operated by the operating projection 22*a*.

Figure 18:
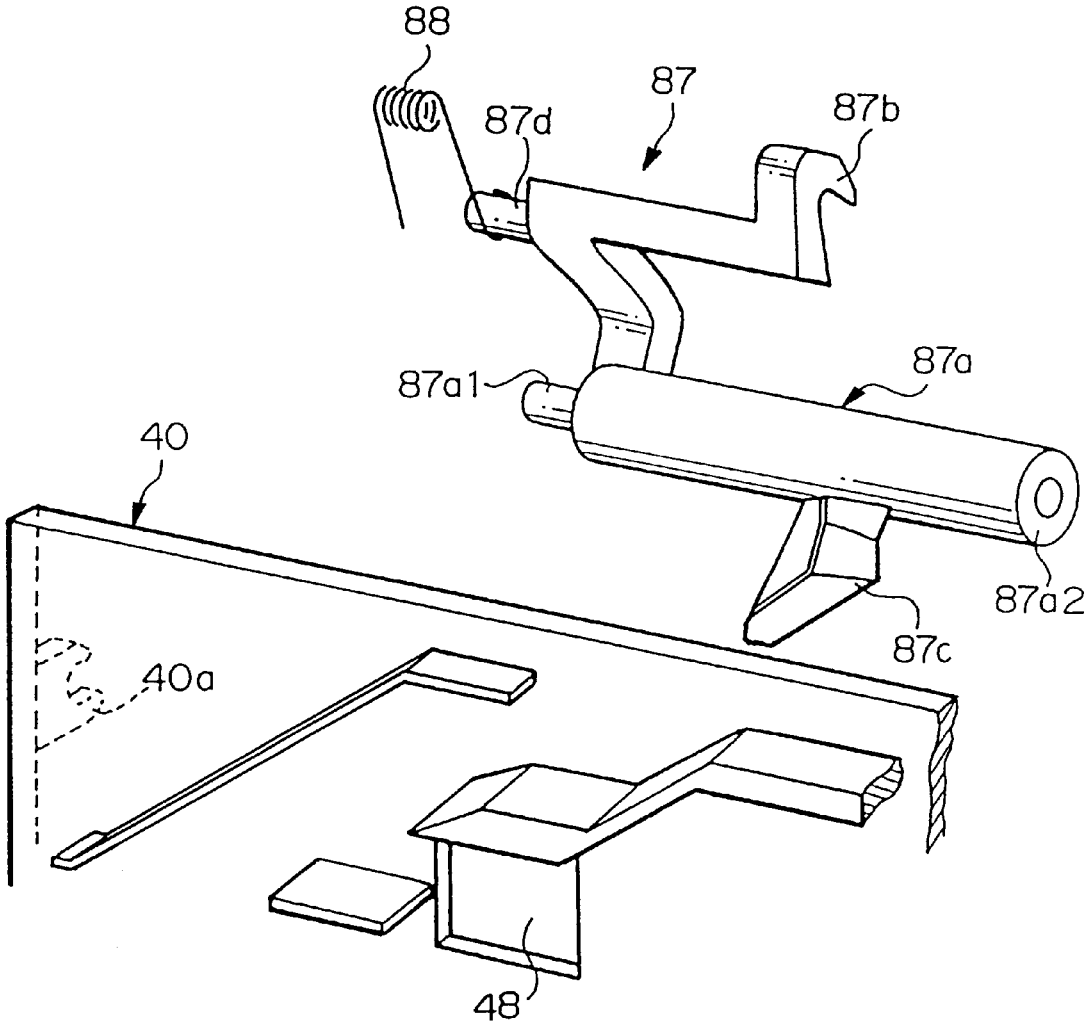
FIG. 18 is an exploded perspective view of an embodiment of a lever employed in the one-revolution clutch shown in FIG. 16.

As shown in FIG. 18, the lever 87 has a shaft 87*a*, a hook portion 87*b* and a projected portion 87*c*. A pin-shaped portion 87*a*1 at the left end of the shaft 87*a* is supported by a bearing portion 40*a* formed on the back of the path forming member 40 and rotatably fitted to the back of the path forming member 40 by fitting a shaft 95 (see FIG. 20), which will be described later, into a tubular portion 87*a*2. The projected portion 87*c* is passed through an opening 48 of the path forming member 40 and made to face the passage R9 (see FIG. 10). Further, a torsion spring 88 is provided between a hook portion 87*d* formed above the shaft 87*a* and a frame (not shown), whereby the lever 87 is usually urged clockwise as shown in FIG. 17. When the lever 87 has been turned clockwise, the hook portion 87*b* is positioned in the rotational orbit of the pin 83*d* of the swing member 83 so as to regulate the turning of the lever 87.

While the hook portion 87*b* of the lever 87 and the pin 83*d* of the swing member 83 in the one-revolution clutch 80 are kept in engagement with each other as shown in FIG. 17(*a*), the rotation of the swing member 83 and the support member 82 clockwise is regulated and the swing member 83 is turned counterclockwise around the shaft 83*a*. Thus, the pawl portion 86*c* of the swing member 83 has been released from the pawl 81*a* of the rachet wheel 81.

Therefore, the motive power is not transmitted to the swing member 83 and the support member 82 even though the rachet wheel 81 is rotated in any direction. The paper feeding roller 86 thus remains unoperational.

As will be described later, on the other hand, the pin 83*d* is released from the hook portion 87*b* when the projected portion 87*c* of the lever 87 is forced down by the operating projection 22*a* so that the lever 87 is turned counterclockwise as shown in FIG. 17(*b*). The swing member 83 and the support member 82 are thus released, and the swing member 83 is swung clockwise round the shaft 83*a* and then the pawl portion 86*c* of the swing member 83 engages with the pawl 81*a* of the rachet wheel 81 (see FIG. 17(*b*)).

When the pinion 71 of the motor 70 is rotated in the direction of an arrow shown in FIG. 13 in this state, the rachet wheel 81 is also rotated in the direction of an arrow therein so that the motive power is transmitted from the pawl 81*a* of the rachet wheel 81 to the pawl portion 86*c* of the swing member 83. Since the swing member 83 and the support member 82 have been coupled together by shaft 83*a*, the swing member 83 and the support member 82 are rotated integrally and printing paper P is fed toward the paper conveying roller 10 when the paper feeding roller 86 is rotated. At this time, the paper conveying roller 10 is also rotated in the direction of the arrow in FIG. 13. In other words, the printing paper P is sent to the rotating paper conveying roller 10.

When the projected portion 87*c* of the lever 87 is released from being held down by the operating projection 22*a* after the swing member 83 and the support member 82 have started their rotation, the lever 87 is turned clockwise due to the urging force of the torsion spring 88, and the tip end of the hook portion 87*b* moves along the outer peripheral face of the rotating swing member 83 (see FIG. 17(*c*)).

When the swing member 83 turns once, thus causing its pin 83*d* to mate with the hook portion 87*b* of the lever 87, the swing member 83 swings counterclockwise round the shaft 83*a* so as to release the pawl portion 86*c* from meshing with the pawl 81*a*, and so that the rotation of the swing member 83 and the support member 82 becomes regulated. In other words, the state shown in FIG. 17(*a*) is established, and the paper feeding roller 86 turns exactly one time.

The rotation of the paper conveying roller 10 is reversed once to move back the tip end of printing paper for the purpose of preventing the printing paper from moving diagonally during the paper feeding operation. Since the swing member 83 swings counterclockwise around the shaft 83*a* so as to release its pawl portion 86*c* from the pawl 81*a* of the rachet wheel 81 even when the rachet wheel 81 turns reversely, however, the paper feeding roller 86 stops and constitutes resistance against the printing paper forced to move backward. Thus, the tip end of the printing paper is aligned uniformly at the joint where the paper conveying roller 10 and its driven roller contact.

The lever 87 for use in actuating the automatic paper feeding unit is fitted to the back of the path forming member 40 as described above and the projected portion 87*c* is, as shown in FIG. 10, passed through the opening 48 of the path forming member 40 and made to face the path R9. As further shown in FIG. 10, the path R9 branches off at a position m from the path R8 and is mainly formed with the surface 44a of the forth partition wall 44 and the horizontal underside of the second partition wall 42. Moreover, the projected portion 87*c* has a tilted face 87*e* and a horizontal face 87*f* consecutive therewith.

Therefore, due to the movement of the carriage 20, which will be described later, the operating projection 22*a* enters the path R9 from the position m, contacts the tilted face 87*e* of the projected portion 87*c* at the position n, and further moves rightward to force the projected portion 87*c* down as shown by the imaginary line, so that the paper feeding roller 86 starts rotating. The operating projection 22*a* is moved upward to the position p and moves out of the path R9 after the swing member 83 has turned a predetermined angle before moving to the left.

A description will now be given of a switching means or the changeover holding means.

The switching gear 73, and gear 12 are supported by the same shaft. The lateral movement of the gear 12 is regulated by its holder 12*c*, which is fixed to the path forming member 40.

The changeover holding means of the switching gear 73 has the path forming member 40, a switching lever 90 which forms the switching means, a torsion spring 97 for urging the switching lever 90, and a pump-side holding means for holding a state in which the switching gear 73 is shifted by the switching lever 90 to the pump side.

Figure 19A:
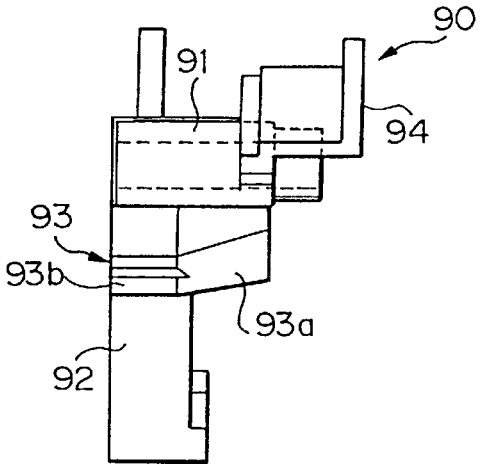
FIGS. 19(*a*)–(*c*) are plan view, elevation and right side views, respectively, of the switching lever shown in FIG. 9.
Figure 19B:
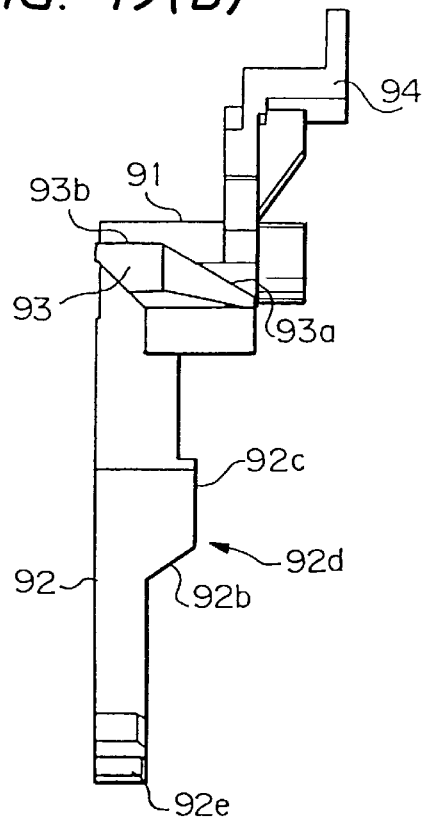
Figure 19C:
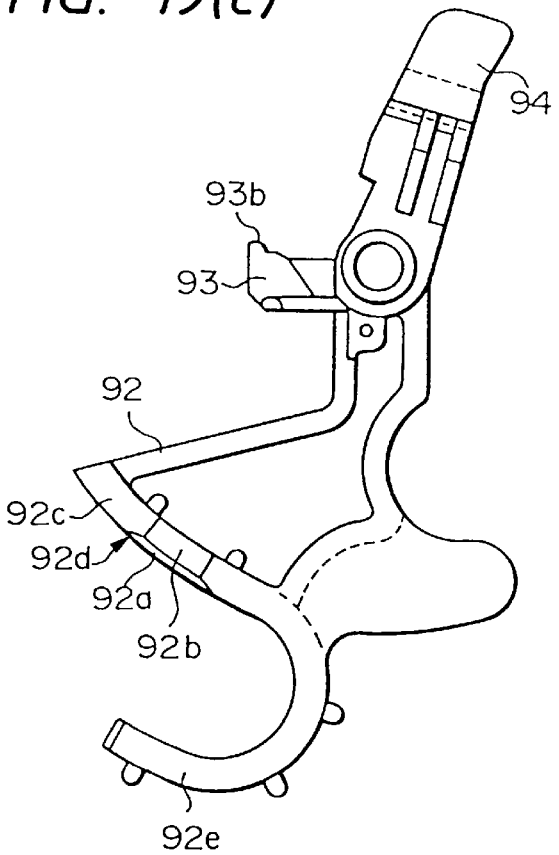
Figure 20:
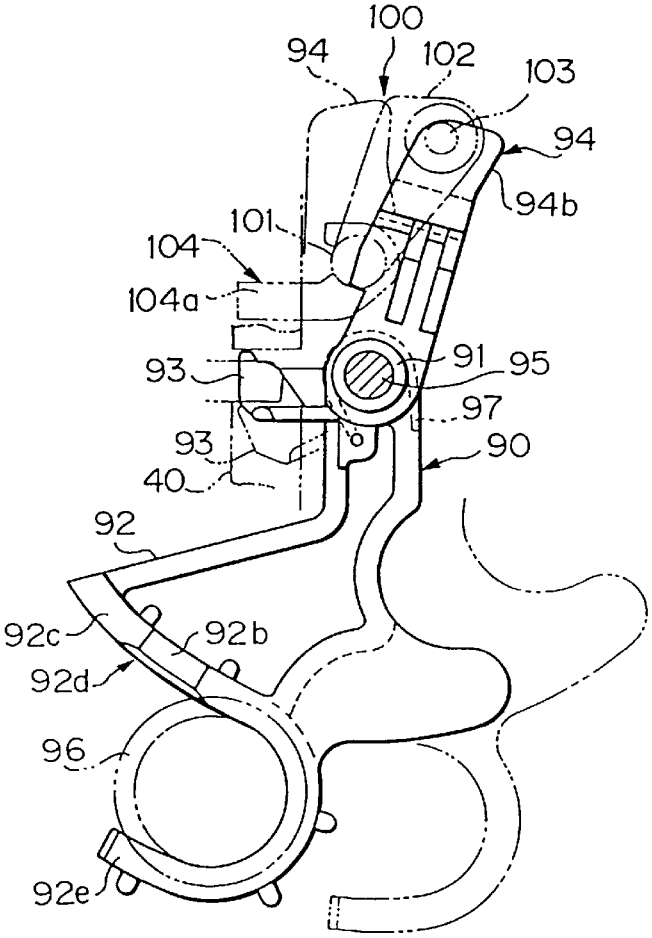
FIG. 20 is a partially omitted right side view taken along lines XX—XX in FIG. 9.

As shown in FIGS. 19(*a*)–19(*c*), the switching lever 90 has a tubular base 91, a substantially fanshaped cam portion 92 coupled to or integrally formed with the lower portion of the base 91, a first driven portion 93 coupled to or integrally formed with the front side of the base 91, and an arm portion 94 formed on the base 91. The tubular base 91 is rotatably supported in the rear of the path forming member 40 as shown in FIG. 20 with a shaft 95 fitted into the tubular portion 87*a*2 of the aforementioned lever 87.

The cam portion 92 has an arcuate portion 92*a* centering on the tubular base 91. A cam 92d having a tilted face 92*b* and a vertical face 92*c* is formed on the arcuate portion 92*a*. A hook portion 92*e*, capable of surrounding the tubular portion 73*b* of the switching gear 73 is formed at the lower end of the cam portion 92 (see FIGS. 9 and 20). A cylindrical ring 96 is placed between the cam 92 and the spur gear portion 73*a* of the switching gear 73.

The surface of the first driven portion 93 includes a tilted face 93a and a horizontal face 93*b*. The first driven portion 93 is projected toward the front side of the path forming member 40 and faces the path R7.

The torsion spring 97 is fitted to the base 91. The switching lever 90 is usually urged clockwise by the spring 97 with reference to FIG. 20, and the turning of the switching lever 90 clockwise is regulated when the first driven member contacts the path forming member 40. The arm portion 94 is used to regulate the turning of the switching lever 90 when the pump-side holding means, which will subsequently be described, is actuated. The pump-side holding means has a slider 100 slidable fitted to the back of the path forming member 40.

As shown in FIGS. 10 and 20, the slider 100 has a shaft 101, an arm portion 102 formed integrally with the shaft 101 substantially at its upper right end, a lock pin 103 fitted to the arm portion 102 and a second driven portion 104 fixed to the shaft 101. The shaft 101 is supported by bearing portions 40*b* and 40*c* formed in the rear of the path forming member 40. A flange portion 101*a* is formed on the shaft 101 and a compression spring 105 is provided between the flange portion 101*a* and the bearing portion 40*b*. The compression spring 105 urges the shaft 101 in the direction of the arrow X2, but the sliding of the shaft 101 in the direction of the arrow X2 is normally regulated by the lock pin 103 whose tip end is brought into contact with the left side 94*a* of the arm portion 94 of the switching lever 90. The second driven portion 104 has a tiled face 104*a* and, as shown in FIGS. 10 and 20, projects forward from the opening 49 of the path forming member 40 and faces the path R7.

The operation of the changeover holding means will subsequently be described by reference to FIGS. 9, 10, 20, 21(*a*) and 21(*b*).

Figure 21A:
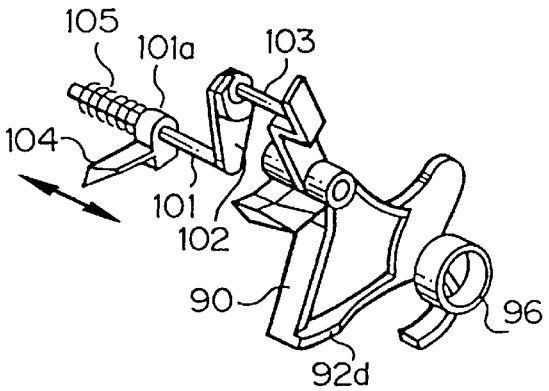
FIGS. 21(*a*)–21(*b*) are perspective views for illustrating an operation of an embodiment of a changeover holding device employing the switching lever shown in FIG. 9.
Figure 21B:
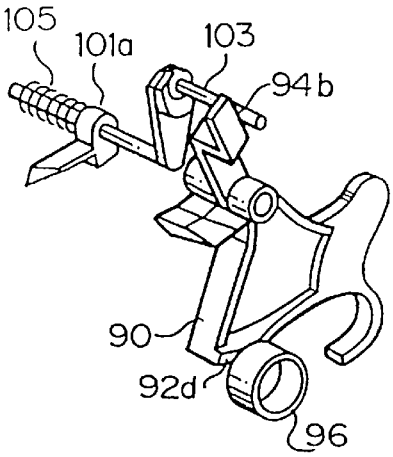

As shown in FIG. 21 (*a*) and by a solid line of FIG. 20, the switching lever 90 is normally in such a state that the torsion spring 97 has turned it clockwise. In this state, the cam 92*d* has been released from the cylindrical ring 96 and consequently, the switching gear 73 is urged by an urging means (not shown) to engage the gear 12. In this state, moreover, the tip end of the lock pin 103 of the slider 100 is, as also shown by the solid line of FIGS. 9 and 10, brought into contact with the left side 94*a* of the arm portion 94 of the switching lever 90.

On the other hand, due to the movement of the carriage 20, which will be described later, the operating projection 22*a* enters the path R6 from the position b with reference to FIG. 10, passes below the first driven portion 93 while holding down the tilted portion 52*d* of the second plate spring 52, reaches a position h, and moves through the path R7 leftward. The operating projection 22*a* is then brought into contact with the tilted face 93*a* of the first driven portion 93 in a position i and moved via a position j to the left further so that the first driven portion 93 is held down as shown by an imaginary line. Then the switching lever 90 is turned counterclockwise against the force of the torsion spring 97 as shown by the imaginary line of FIG. 20. Thus, the cam 92*d* causes the switching gear 73 to slide to the right via the cylindrical ring 96 as shown by the imaginary line of FIG. 9, and to engage with the pump driving gear 64 so that the pump 60 can be driven.

When the operating projection 22*a*, which is passed from the position j to the position b, moves above the horizontal face 93*b* of the first driven portion 93, thus causing the switching lever 90 to be turned as shown by the imaginary line of FIG. 20, the left side 94*a* of the arm portion 94 is released from contacting the tip end of the lock pin 103, and the compression spring 105 makes the slider 100 slide in the direction of the arrow X2. Then, the lock pin 103 is situated in the rear of the arm portion 94, as shown by the imaginary line of FIGS. 10 and 21(*b*), and brought into contact with the back 94*b* of the arm portion 94, so that the turning of the switching lever 90 clockwise is regulated (locked). Therefore, the switching gear 73 is kept in engagement with the pump driving gear 64 in this state, which is held until the slider 100 is released from being locked by the lock pin 103 after sliding in the direction of the arrow X1.

The locking is released when the operating projection 22*a* enters the path R8 after the carriage 20 is moved so as to move the second driven portion 104 in the direction of the arrow X1 as shown by the position k and the imaginary line. When the operating projection 22*a* causes the second driven portion 104 to move in the direction of the arrow X1 as shown by the position k after entering the path R8, the lock pin 103 is also moved in the direction of the arrow X1 and the switching lever 90 is turned clockwise as shown by the solid line of FIG. 20 at a point of time the tip end of the lock pin 103 escapes from the back 94*b* of the arm portion 94. As a result, the cam 92*d* is released from the cylindrical ring 96 and the switching gear 73 slides to the left and engages with the gear 12 as shown in FIG. 9. The compression spring 105 allows the lock pin 103 to slide in the direction of the arrow X2 again at a point of time the operating projection 22*a* is released from the second driven portion 104. Since the switching lever 90 has been turned clockwise as described above, the tip end of the lock pin 103, which attempts to slide in the direction of the arrow X2, runs against the left side 94*a* of the arm portion 94, so that the state shown in FIG. 21(*a*) is restored. This state is held until the operating projection 22*a* enters path R7 from path R6 again and turns the switching lever 90 counterclockwise.

After the operating projection 22*a* enters path R7 and operates the first driven portion 93 so as to switch the switching gear 73 to the pump driving side once, this state is held unless the operating projection 22*a* is passed through path R8. When the operating projection 22*a* is passed through path R8 to operate the second driven portion 104 so as to switch the switching gear 73 to the driving side of the paper conveying means, this state is held unless the operating projection 22*a* is passed through path R7.

With the arrangement above, the carriage 20 is set free from moving as long as the operating projection 22*a* is passed through the drive path after the changeover holding means is actuated and the suction pump 60 can be driven, irrespective of the position of the carriage 20.

The cleaning member (cleaning means) 110, as shown in FIG. 1, will now be described.

The cleaning member 110 has a base 111 and two pieces of cleaning members 112 and 113 fitted to the base 111. One cleaning member 112 is formed of a rubber sheet, for example, or the like, whereas the other cleaning member 113 is formed, for example, of a felt sheet or the like. These cleaning members 112 and 113 are held by the base 111.

An elevator mechanism (not shown) makes the base 111 capable of moving up and down. The elevator mechanism according to this embodiment of the invention is arranged so that it has a cam incorporated in the driving system of the pump 60 and is driven by the motor 70.

The base 111 of the cleaning member 110 is moved downward as shown in FIGS. 1, 7(*a*), and 7(*b*) during a non-cleaning operation to prevent the upper end 114 from coming into contact with the ink-jet face 21*a* of the head 21.

On the other hand, the base 111 is moved upward as shown in FIGS. 7(*c*) or (*d*) during a cleaning operation to make the upper end 114 sufficiently contact the ink-jet face 21*a* of the head 21. While the base 111 is in the upper position, the ink-jet face 21*a* of the head 21 is kept in slidable contact with the cleaning members 112 and 113 by moving the carriage 20 back and forth, whereby paper dust and the like sticking to the ink-jet face 21*a* is removed. In this case, with reference to FIGS. 7(*a*)–7(*d*), the ink-jet face 21*a* is cleaned by one cleaning member 112 when the carriage 20 is moved from left to right, and by the other cleaning member 113 when the carriage 20 is moved from right to left.

In order to perform the cleaning operation, the necessary reciprocating stroke of the carriage 20 is at least not less than the length of the ink-jet face 21*a* (lateral length in FIG. 1)+α (the length required to ensure that the cleaning member 112 or 113 is off the ink-jet face 21*a*). According to this embodiment of the invention, the length L (see FIG. 10) in the reciprocating direction of the carriage 20 in the nonoperating paths R1–R5 (see FIG. 10) is set greater than the stroke above.

A description will subsequently be given of the standby condition and operation of the ink-jet printer thus arranged.

While no power is applied to the printer or the power is turned on (the standby condition), the carriage 20 remains in the home position shown in FIG. 7(*c*) when no print command signal is fed from the host computer connected to the printer. In this state, the cap 31 is tightly joined to the ink-jet face 21*a* to prevent ink at the tips of nozzles from drying up, that is, the capping state has been established. Further, the operating projection 22*a* is in the position s shown in FIG. 10 and restrained from entering the printing area A of the carriage 20. The one-revolution clutch 80 is in the state shown in FIG. 17(*a*) and the switching gear 73 becomes engaged with the gear 12 as shown by the solid line of FIG. 9.

When the print command signal is supplied from the host computer (the print operation), the carriage 20 is moved so that the operating projection 22*a* is moved from the position s through path R1→position a→path R2→path R3→position c→path R4→position e→path R8→position m→path R9→position p. Although the slider 100 is slid in the direction of the arrow X1 once while the operating projection 22*a* is passing through the path R8, it is only returned to the original position (the state shown by the solid line of FIG. 10) after the operating projection 22*a* has passed the position k and any other member is not made to operate.

The motor 70 is actuated at a point of time when the operating projection 22*a* has reached the position p and the one-revolution clutch 80, that is, the paper feeding roller 86 as well as the paper conveying roller 10 starts rotating, so that the feeding of printing paper toward the underside of the head 21 is started. The carriage 20 is moved so that the operating projection 22*a* is moved from the position p through path R9→path R8→position c→path. R4→path R5→position f. The position of the path R when the operating projection 22*a* is in the position f is the position of FIG. 7(*b*), that is, the flushing position. The flushing operation is performed so that ink at the tip ends of the nozzles of the head 21 in the standby condition which may have been dried up, can be removed.

The carriage 20 is moved to the left and into the printing area A, whereby the printing operation is performed. At this time, the operating projection 22*a* is moved from the position f through path R5 (to the left)→path R8→printing area A. The printing operation is based on the print command signal in that the paper conveying roller 10 is driven by the motor 70 to send paper by a predetermined quantity (normally a line-to-line pitch) and that while the carriage 20 is reciprocating, the head 21 jets out ink. Upon the termination of the printing operation, the carriage 20 is returned to the home position and the aforementioned standby position.

The flushing operation is performed periodically during the printing operation. As shown in FIG. 7(*b*), the flushing operation is performed in that the carriage 20 enters the nonprinting area B (see FIG. 1) until the head 21 is positioned opposite to the cap 31, in which position ink is jetted out of all of the nozzles. Then the carriage 20 is returned to the printing area A, so that the printing operation is continued.

The movement of the operating projection 22*a* at this time is as follows: printing area A→path R4→path R5→position f (flushing)→path R5 (to the left)→path R8→printing area A.

This flushing suction operation is performed after the flushing operation has been performed a predetermined number of times (before ink overflows the cap 31). In this case, the operating projection 22*a* is moved as follows: printing area A→path R4→path R5→path R1→path R2→position b→path R6→path R7→position b.

When the operating projection 22*a* is passed through path R7, the first driven portion 93 is held down as shown by the imaginary line and the switching lever 90 is turned counterclockwise as shown by the imaginary line of FIG. 20. Further, the switching gear 73 engages with the pump driving gear 64 to make the pump drivable and this state is held by the lock pin 103 of the slider 100.

The pump 60 is driven for a predetermined time (or a predetermined number of revolutions) by actuating the motor 70. Thus the flushing ink stored in the recess 31*c* of the cap 31 is sucked therefrom.

Then, the carriage 20 is moved so that the operating projection 22*a* is moved as follows: position b→path R3→position c→path R4→position e→path R8→printing area A. The carriage 20 thus continues the printing operation in the printing area A.

While the operating projection 22*a* is passing through the path R8, it causes the second driven portion 104 to move in the direction of the arrow X1 as shown by the imaginary line as described above, whereby the lock pin 103 is also moved in the direction of the arrow X1. The tip end of the lock pin 103 escapes from back 94*b* of the arm portion 94 and causes the switching lever 90 to turn clockwise as shown by the solid line of FIG. 20. Then, the switching gear 73 is slid to the left with reference to FIG. 9 and made to engage with the gear 12 so that printing paper can be conveyed during the printing operation.

The timing at which the carriage 20 is moved so that the operating projection 22*a* is moved from position b through path R3→position c→path R4→position e→path R8→printing area A is at least such that while the operating projection 22*a* is passing through the path R8, the driving of the pump is terminated before the second driven portion 104 is moved in the direction of the arrow X1 as shown by the imaginary line. In other words, the carriage 20 may be moved before the operation of the pump 60 is terminated after the operating projection 22*a* is passed through the path R7. Therefore, the flushing suction operation can be shifted to the printing operation in a short time.

When the nozzles are clogged with dried ink or there is the possibility that they are clogged therewith, a pumping operation is performed. More specifically, the pumping operation is performed by operating a control panel of the printer on the part of a user or otherwise each time the power supply of the printer is put to work a predetermined number of times (e.g., once whenever the power supply is put to work twice) as follows.

The carriage 20 is moved so that the operating projection 22*a* is moved from the position s through path R1→path R2→position b→path R6→path R7→position b→path R3→path R4→path R5 and returned to the position s again. When the carriage 20 is returned to the position s, the cap 31 is kept in tight contact with the ink-jet face 21*a* and the ink suction system (see FIG. 8) is in such a state that the opening 36*b* of the switching valve 35 is closed by the valve element 37. Thus, the proper suction can be carried out.

On the other hand, the first driven portion 93 is held down at the time the operating projection 22*a* has passed through the path R7 and the switching lever 90 is turned counterclockwise as shown by the imaginary line of FIG. 20. Then the switching gear 73 is made to engage with the pump driving gear 64 so that the pump can be driven and this state is held by the lock pin 103 of the slider 100.

Then, the pump 60 is driven for a predetermined time (or a predetermined number of revolutions) by actuating the motor 70 after the carriage 20 is returned to the position s and ink is forcibly sucked from the whole nozzle of the head 21. Thus, the proper suction is carried out.

The carriage 20 is moved to the right so that the operating projection 22*a* is passed through the path R4 from the position s and placed in the position s.

While the carriage 20 is moving to the right, the cap 31 is kept in tight contact with the ink-jet face 21*a* as shown in FIG. 7(*d*) and the ink suction system (see FIG. 8) is in such a state that the valve stem 38 of the switching valve 35 is brought into contact with the frame 1 and moved in the direction of the arrow X1 of FIG. 8. Then, the opening 36*b* is opened and the draining suction can be performed.

Then the pump 60 is driven for a predetermined time (or a predetermined number of revolutions) by actuating the motor 70 so as to carried out the draining suction, whereby only the ink in the recess 31*c* of the cap 31 is sucked and discharged without sucking ink from the nozzles of the head 21. Thus, ink is prevented from overflowing the recess 31*c* even though the carriage 20 is then moved.

The carriage 20 is moved so that the operating projection 22*a* is moved from the position a through path R2→path R3→position c→path R4→position e→path R8→position c→path R4→path R5 and returned to the position s again and placed in the aforementioned standby condition. While the operating projection 22*a* is passing through the path R8, the second driven portion 104 is moved in the direction of the arrow X1, whereby the switching lever 90 is turned clockwise as shown by the solid line of FIG. 20. Thus, the switching gear 73 is slid to the left with reference to FIG. 9 and made to engage with the gear 12.

When paper dust and the like stick to the ink-jet face 21*a* of the head 21 or there is the possibility that they stick thereto, the cleaning operation is performed so as to remove them. More specifically, the cleaning operation is performed by operating the control panel of the printer on the part of the user or otherwise each time the power supply of the printer is put to work a predetermined number of times (e.g., once whenever the power supply is put to work twice) as follows.

The carriage 20 is moved so that the operating projection 22*a* is moved from the position s through path R1→path R2→position b→path R6→path R7→position b→path R3→position c. At the time the operating projection 22*a* is passed through the path R7, the switching gear 73 is caused to engage with the pump driving gear 64. The motor 70 is driven to the extent that the cam incorporated in the driving system of the pump 60 is actuated and the base 111 of the cleaning member 110 is moved upward. Thus, the upper end 114 of the cleaning members 112 and 113 becomes capable of sliding on the ink-jet face 21*a* of the head 21. In the case of a printer wherein the elevator mechanism of the base 111 is not incorporated in the driving system of the pump 60 but has an independent elevator mechanism, the base 111 is moved upward by actuating the elevator mechanism.

The carriage 20 is reciprocated a predetermined number of times so that the operating projection 22*a* is moved from the position c through path R4→path R5→path R1→path R2→path R3→position c. The ink-jet face 21*a* of the head 21 is thus brought into slidable contact with the upper end of the cleaning members 112 and 113, so that paper dust and the like sticking to the ink-jet face 21*a* are scraped off.

The base 111 of the cleaning member 110 is moved downward by reversely driving the motor 70. Then the upper end 114 of the cleaning members 112 and 113 is put out of slidable contact with the ink-jet face 21*a* of the head 21.

The carriage 20 is moved so that the operating projection 22*a* is moved from the position c through passage R4→path R5→position e→path R8→position c→path R4→path R5 and returned to the position s again and placed in the aforementioned standby condition. While the operating projection 22*a* is passing through the path R8, the second driven portion 104 is moved in the direction of the arrow X1, whereby the switching lever 90 is turned clockwise as shown by the solid line of FIG. 20. Thus, the switching gear 73 is slid to the left with reference to FIG. 9 and made to engage with the gear 12.

This combined operation is performed so as to combine any two or more of the following operations: the flushing operation, a pump driving operation (the operation of driving the pump 60), the pumping operation and the cleaning operation. The setting of the following operating modes is possible.

(1) A combined operation including the flushing, pump driving, pumping and cleaning operations;

(2) A combined operation including the flushing, pump driving and pumping operations;

(3) A combined operation including the flushing, pump driving and cleaning operations;

(4) A combined operation including the flushing, pumping and cleaning operations;

(5) A combined operation including the flushing and pump driving operations;

(6) A combined operation including the flushing and pumping operations;

(7) A combined operation including the flushing and cleaning operations;

(8) A combined operation including the pumping and cleaning operations.

Although there are 11 combinations when these four operations are simply combined together, the combination of pump driving, pumping and cleaning operations is practically unnecessary because it is meaningless to combine the cleaning operation simultaneously with the pump driving and pumping operations. Moreover, because it is also meaningless to combine the pump driving and pumping operations or the pump driving and cleaning operations, ultimately eight combinations are usable.

Among all of these eight operating modes, any given one mode or otherwise a plurality of single modes may be set. Moreover, such a combined operation may be performed by operating the control panel of the printer on the part of the user or otherwise each time the power supply of the printer is put to work a predetermined number of times (e.g., once whenever the power supply is put to work twice).

A description will subsequently be given of the combinations (1)–(8) successively; first the combination (1), and then the combinations (2)–(8) briefly since the latter consists of those excluding one or two operations from (1).

The combination of flushing, pump driving and cleaning operations may be performed as follows:

(i) The carriage 20 is moved so that the operating projection 22*a* is moved from the position s through path R1→path R2→position b→path R6→path R7→position b→path R3→position c. At the time the operating projection 22*a* is passed through the path R7, the switching gear 73 becomes engaged with the pump driving gear 64.

(ii) The base 111 of the cleaning member 110 is moved upward by actuating the motor and the cam incorporated in the driving system of the pump 60, whereby the upper end 114 of the cleaning members 112 and 113 is brought into slidable contact with the ink-jet face 21*a* of the head 21. The pump 60 may be driven in this state by actuating the motor further. It is possible to drive the pump 60 by actuating the motor further after the base 111 of the cleaning member 110 is moved upward by actuating the cam incorporated in the driving system of the pump 60. In this case, the cam is actuated through a friction clutch, for example.

(iii) The carriage 20 is moved so that the operating projection 22*a* is moved from the position c through path R4→path R5 and stopped at position f. While the carriage 20 is moving, the ink-jet face 21*a* is brought in slidable contact with the one cleaning member 112 and cleaned.

(iv) Flushing is then carried out after the carriage 20 is stopped. Flushing ink that has been jetted into the recess 31*c* of the cap 31 is successively sucked by driving the pump 60 at this time. Therefore, no ink overflows the recess 31*c*. Incidentally, the pump 60 may be driven intermittently in order to prevent ink from overflowing the recess 31*c*.

(v) The carriage 20 is moved to the home position (shown in FIG. 7(*c*)) after the flushing and pump driving operations are stopped and then the pumping operation is performed. Upon the termination of the pumping operation, the carriage 20 is moved to the position shown in FIG. 7(*d*) and the draining suction is carried out.

(vi) The carriage 20 is moved so that the operating projection 22*a* is moved from the position a through path R2→path R3→position c. While the carriage 20 is thus moving, the ink-jet face 21*a* is brought into slidable contact with the other cleaning member 113 and cleaned. At this time, the pump 60 may be kept operating or otherwise stopped.

(vii) The operations (iii)–(vi) are repeated a predetermined number of times as needed.

(viii) The base 111 of the cleaning member 110 is moved downward by reversely driving the motor 70, whereby the upper end 114 of the cleaning members 112 and 113 is put out of slidable contact with the ink-jet face 21*a* of the head 21.

(ix) The carriage 20 is moved so that the operating projection 22*a* is moved from the position c through path R4→position e→path R8→position c→path R4→path R5 and returned to the position c. Thus, the aforementioned standby condition is established. While the operating projection 22*a* is passing through the path R8, the switching gear 73 is shifted to the side of the gear 12 as described above.

The combination of flushing, pump driving and pumping operations is performed by mainly operating the control panel on the part of the user when so-called dot omission and the like occur during the aforementioned printing operation, for example.

(i) When the control panel is operated by the user, the printing operation is stopped and the carriage 20 is moved so that the operating projection 22*a* is passed through printing area A→path R4→path R5→path R1→path R2→position b→path R6→path R7→position b→path R3→position c→path R4→path R5 and stopped at the position f. At the time the operating projection 22*a* is passed through the path R7, the switching gear 73 becomes engaged with the pump driving gear 64.

(ii) Flushing is performed and the pump 60 is driven after the carriage 20 is stopped. Then, the flushing ink jetted into the recess 31*c* of the cap 31 is successively sucked out. Therefore, no ink overflows the recess 31*c*.

(iii) The carriage 20 is moved to the home position and the pumping operation is performed after the flushing and pump driving operations are stopped. Upon the termination of the pumping operation, the carriage 20 is moved to the position shown in FIG. 7(*d*) and the draining suction is carried out.

(iv) The carriage 20 is moved so that the operating projection 22*a* is moved from the position a through path R2→path R3→position c→path R4→position e→path R8→position c→printing area A and then the printing operation is continued. While the operating projection 22*a* is passing through the path R8, the switching gear 73 is shifted to the side of the gear 12.

The combined operation may be performed when the power supply is put to work. The operation in this case is not different except that it is started when the operating projection 22*a* is in the position s and the operating projection 22*a* is returned to the home position (position s) upon its termination. This also applies to the combinations, which will be described below.

The combination of flushing, pump driving and cleaning operations is mainly performed by operating the control panel on the part of the user when so-called dot omission and the like occur during the aforementioned printing operation, for example.

(i) When the control panel is operated by the user, the printing operation is stopped and the carriage 20 is moved so that the operating projection 22*a* is passed through printing area A→path R4→path R5→path R1→path R2→position b→path R6→path R7→position b→path→R3 and stopped at the position c. At the time the operating projection 22*a* is passed through the path R7, the switching gear 73 becomes engaged with the pump driving gear 64.

(ii) The base 111 of the cleaning member 110 is moved upward by actuating the motor and the cam incorporated in the driving system of the pump 60.

(iii) The carriage 20 is moved so that the operating projection 22*a* is moved from the position c through path R4→path R5 and stopped at the position f. While the carriage 20 is moving, the ink-jet face 21*a* is brought in slidable contact with the cleaning member 112 and cleaned.

(iv) Flushing is carried out after the carriage 20 is stopped.

Flushing ink that has been jetted into the recess 31*c* of the cap 31 is successively sucked by driving the pump 60 at this time. Therefore, no ink overflows the recess 31*c*.

(v) The carriage 20 is moved so that the operating projection 22*a* is moved from the position f through path R5→path R1→path R2→position c after the flushing and pump driving operations are stopped. While the carriage 20 is moving, the ink-jet face 21*a* is brought into slidable contact with the other cleaning member 113 and cleaned. At this time, the pump 60 may be kept operating or otherwise stopped.

(vi) The operations (iii)–(v) are repeated a predetermined number of times as occasion demands.

(vii) The base 111 of the cleaning member 110 is moved downward by reversely driving the motor 70, whereby the upper end 114 of the cleaning members 112 and 113 is put out of slidable contact with the ink-jet face 21*a* of the head 21.

(viii) The carriage 20 is moved so that the operating projection 22*a* is moved from the position c through path R4→position e→path R8→position c→printing area A and then the printing operation is continued. While the operating projection 22*a* is passing through the path R8, the switching gear 73 is shifted to the side of the gear 12.

The combination of flushing, pumping and cleaning operations is mainly performed by operating the control panel on the part of the user when so-called dot omission and the like occur during the aforementioned printing operation, for example.

(i) When the control panel is operated by the user, the printing operation is stopped and the carriage 20 is moved so that the operating projection 22*a* is passed through printing area A→path R→path R5→path R1→path R2→position b→path R6→path R7→position b→path R3 and stopped at the position c. At the time the operating projection 22*a* is passed through the path R7, the switching gear 73 becomes engaged with the pump driving gear 64.

(ii) The base 111 of the cleaning member 110 is moved upward by actuating the motor and the cam incorporated in the driving system of the pump 60.

(iii) The carriage 20 is moved so that the operating projection 22*a* is moved from the position c through path R4→path R5 and stopped at the position f. While the carriage 20 is moving, the ink-jet face 21*a* is brought in slidable contact with the one cleaning member 112 and cleaned.

(iv) Flushing is carried out after the carriage 20 is stopped.

The flushing is carried out a number of times necessary for preventing flushing ink from overflowing the recess 31*c* of the cap 31.

(v) The carriage 20 is moved to the home position (shown in FIG. 7(*c*)) and the pumping operation is performed. Upon the termination of the pumping operation, the carriage 20 is moved to the position shown in FIG. 7(*d*), and the draining suction is carried out.

(vi) The carriage 20 is moved so that the operating projection 22*a* is moved from the position a through path R2→path R3→position c. While the carriage 20 is thus moving, the ink-jet face 21*a* is brought into slidable contact with the other cleaning member 113 and cleaned.

(vii) The operations (iii)–(vi) are repeated a predetermined number of times as occasion demands.

(viii) The base 111 of the cleaning member 110 is moved downward by reversely driving the motor 70, whereby the upper end 114 of the cleaning members 112 and 113 is put out of slidable contact with the ink-jet face 21*a* of the head 21.

(ix) The carriage 20 is moved so that the operating projection 22*a* is moved from the position c through path R4→position e→path R8→position c→printing area A and then the printing operation is continued. While the operating projection 22*a* is passing through the path R8, the switching gear 73 is shifted to the side of the gear 12.

The combination of flushing and pump driving operations is mainly performed by operating the control panel on the part of the user when so-called dot omission and the like occur during the aforementioned printing operation, for example.

(i) When the control panel is operated by the user, the printing operation is stopped and the carriage 20 is moved so that the operating projection 22*a* is passed through printing area A→path R4→path R5→path R1→path R2→position b→path R6→path R7→position b→path R3→position c→path R4→path R5 and stopped at the position f.

(ii) Flushing is carried out after the carriage 20 is stopped.

Flushing ink that has been jetted into the recess 31*c* of the cap 31 is successively sucked by driving the pump 60 at this time. Therefore, no ink overflows the recess 31*c*.

(iii) The carriage 20 is moved so that the operating projection 22*a* is moved from the position f through path R5 (opposite direction)→position e→path R8→position c→printing area A after the flushing and pump driving operations are stopped and then the printing operation is continued. While the operating projection 22*a* is passing through the path R8, the switching gear 73 is shifted to the side of the gear 12.

The combination of flushing and pumping operations is mainly performed by operating the control panel on the part of the user when so-called dot omission and the like occur during the aforementioned printing operation, for example.

(i) When the control panel is operated by the user, the printing operation is stopped and the carriage 20 is moved so that the operating projection 22*a* is passed through printing area A→path R4→path R5→path R1→path R2→position b→path R6→path R7→position b→path R3→position c→path R4→path R5 and stopped at the position f.

(ii) Flushing is carried out after the carriage 20 is stopped. The flushing is carried out a number of times necessary for preventing flushing ink from overflowing the recess 31*c* of the cap 31.

(iii) The carriage 20 is moved to the home position (shown in FIG. 7(*c*)) and the pumping operation is performed. Upon the termination of the pumping operation, the carriage 20 is moved to the position shown in FIG. 7(*d*) and the draining suction is carried out.

(iv) The carriage 20 is moved so that the operating projection 22*a* is moved from the position a through path R2→path R3→position c→path R4→position e→path R8→position c→printing area A and then the printing operation is continued.

The combination of flushing and cleaning operations is mainly performed by operating the control panel on the part of the user when so-called dot omission and the like occur during the aforementioned printing operation, for example.

(i) When the control panel is operated by the user, the printing operation is stopped and the carriage 20 is moved so that the operating projection 22*a* is passed through printing area A→path R4→path R5→path R1→path R2→position b→path R6→path R7→position b→path R3 and stopped at the position c. At the time the operating projection 22*a* is passed through the path R7, the switching gear 73 becomes engaged with the pump driving gear 64.

(ii) The base 111 of the cleaning means 110 is moved upward by actuating the motor 70 and the cam incorporated in the driving system of the pump 60.

(iii) The carriage 20 is moved so that the operating projection 22*a* is moved from the position c through path R4→path R5 and stopped at the position f. While the carriage 20 is moving, the ink-jet face 21*a* is brought in slidable contact with the one cleaning member 112 and cleaned.

(iv) Flushing is carried out after the carriage 20 is stopped. The flushing is carried out a number of times necessary for preventing flushing ink from overflowing the recess 31*c* of the cap 31.

(v) The carriage 20 is moved so that the operating projection 22*a* is moved from the position f through path R5→path R1→path R3→position c. While the carriage 20 is thus moving, the ink-jet face 21*a* is brought into slidable contact with the other cleaning member 113 and cleaned.

(vi) The operations (iii)–(v) are repeated a predetermined number of times as occasion demands.

(vii) The base 111 of the cleaning means 110 is moved downward by reversely driving the motor 70, whereby the upper end 114 of the cleaning members 112 and 113 is put out of slidable contact with the ink-jet face 21*a* of the head 21.

(viii) The carriage 20 is moved so that the operating projection 22*a* is moved from the position c through path R4→position e→path R8→position c→printing area A and then the printing operation is continued. While the operating projection 22*a* is passing through the passage R8, the switching gear 73 is shifted to the side of the gear 12.

The combination of pumping and cleaning operations is mainly performed by operating the control panel on the part of the user when so-called dot omission and the like occur during the aforementioned printing operation, for example.

(i) When -the control panel is operated by the user, the printing operation is stopped and the carriage 20 is moved so that the operating projection 22*a* is passed through printing area A→path R4→path R5→path R1→path R2→position b→path R6→path R7→position b→path R3 and stopped at the position c. At the time the operating projection 22*a* is passed through the path R7, the switching gear 73 becomes engaged with the pump driving gear 64.

(ii) The base 111 of the cleaning means 110 is moved upward by actuating the motor 70 and the cam incorporated in the driving system of the pump 60.

(iii) The carriage 20 is moved so that the operating projection 22*a* is moved from the position c through path R4→path R5 and stopped at the position s (home position). While the carriage 20 is moving, the ink-jet face 21*a* is brought in slidable contact with the one cleaning member 112 and cleaned.

(iv) The pumping operation is performed after the carriage 20 is stopped. Upon the termination of the pumping operation, the carriage 20 is moved to the position shown in FIG. 7(*d*) and the draining suction is carried out.

(v) The carriage 20 is moved so that the operating projection 22*a* is moved from the position a through path R2→path R3→position c. While the carriage 20 is thus moving, the ink-jet face 21*a* is brought into slidable contact with the other cleaning member 113 and cleaned.

(vi) The operations (iii)–(v) are repeated a predetermined number of times as occasion demands.

(vii) The base 111 of the cleaning member 110 is moved downward by reversely driving the motor 70, whereby the upper end 114 of the cleaning members 112 and 113 is put out of slidable contact with the ink-jet face 21*a* of the head 21.

(viii) The carriage 20 is moved so that the operating projection 22*a* is moved from the position c through path R4→position e→path R8→position c→printing area A and then the printing operation is continued.

As demonstrated above, the ink-jet printer according to this embodiment of the invention has the following effect:

Printing paper is conveyed by the paper conveying means 10, and jets of ink are sent from the nozzles formed on the ink-jet face fitted to the carriage which reciprocates in a direction perpendicular to the direction in which the printing paper is conveyed. Thus, characters are printed on the paper.

When the printing operation is not performed for a certain period of time, the cap is tightly joined to the ink-jet face of the head so that ink is prevented from drying up and the nozzles of the head are thus prevented from being clogged with dried ink. In a case where the nozzles are clogged with the dried ink, the function of the head can be recovered by tightly joining the cap to the ink-jet face of the head and forcibly sucking the ink out of the nozzles by the suction pump.

In order to drive the suction pump 60, the operating projection 22*a* is made to enter the operating path R7 by moving the carriage 20. The first driven portion 93 of the changeover holding means faces in the operating path R7 and the changeover holding means is actuated when the operating projection 22*a* is brought into contact with the first driven portion 93. As the switching gear 73 is then shifted to the transfer position and held in that position, the suction pump 60 can be driven.

In order to release the suction pump 60 from being driven, on the other hand, the operating projection 22*a* is made to enter the operating path R8 by moving the carriage 20. The second driven portion 104 of the changeover holding means faces in the operating path R8 and the changeover holding means is actuated when the operating projection 22*a* is brought into contact with the second driven portion 104. As the switching gear 73 is then shifted to the non-transfer position and held in that position, the driving condition of the suction pump 60 can be released.

Since the path of the operating projection 22*a* has the non-operating paths R1–R5 where the changeover holding means is not actuated even when the operating projection enters the passages, the changeover holding means is not actuated as long as the carriage 20 is moved so that the operating projection 22*a* is passed through only the driven passage after the changeover holding means is actuated once. Therefore, the switching gear 73 is kept on the shifted side.

With the above arrangement, the carriage is set free from moving as long as the operating projection 22*a* is passed through only the driven paths R1–R5 after the changeover holding means is actuated and the suction pump 60 can be driven, irrespective of the position of the carriage 20. Therefore, the freedom of the carriage 20 in the ink-jet printer during the operating of the suction pump 60 is increased.

Furthermore, the ink-jet printer is capable of cleaning the ink-jet face 21*a* by reciprocating the carriage 20 in such a manner as to bring the ink-jet face 21*a* in slidable contact with the cleaning member 110, and the length of the non-operating paths R1–R5 in the reciprocating direction of the carriage 20 is not less than the stroke of reciprocation of the carriage 20 necessary for the cleaning operation. Therefore, the cleaning of the ink-jet face 21*a* can be carried out by reciprocating the carriage 20 to make the operating projection 22*a* pass through only the driven paths R1-R5 after the changeover holding means is actuated once.

The cleaning operation can be performed while the suction pump 60 is being driven.

Furthermore, the movement preventive means for preventing the carriage 20 in the standby position from moving toward the printing area A includes the blocking wall 42*e* which can be brought into contact with the operating projection 22*a* and is provided closer to the printing area A than the position s of the operating projection 22*a* in the path while the carriage is in the standby position (shown in FIG. 7(*c*)). Hence, a special stopper that has heretofore been necessitated for the movement preventive purpose is not needed. Therefore, the number of component parts can be reduced and simultaneously the construction is simplified.

The path of the operating projection 22*a* has the entry paths R4 and R5 through which the operating projection 22*a* passes when the carriage 20 enters the nonprinting area B, and exit paths R2 and R3 through which the operating projection 22*a* passes when the carriage 20 escapes from the nonprinting area B into the printing area A. The blocking wall 42*e* is provided close to the end portion of the entry path and the start portion of the exit path is situated in the position displaced from the end portion and opposite to the printing area. Therefore, the carriage 20 in the standby position can easily be moved into the printing area by moving the carriage in a direction opposite to the printing area once.

More specifically, the operating projection 22*a* is positioned in the start portion (position a in FIG. 10) of the exit path when the carriage 20 in the standby position is moved in a direction opposite to the printing area. As the operating projection 22*a* is then passed through the exit path, the carriage is allowed to escape from the nonprinting area B into the printing area A by moving the carriage 20 toward the printing area.

The cap 31 is provided with the first opening 31*b* connected to the suction pump 60, the second opening 31*a* different from the first opening 31*b* and capable of communicating with the air and the switching valve 35 connected to the second opening 31*a*. The cap is movable together with the carriage 20 when the carriage is moved. The switching valve 35 is switched in response to the movement of the carriage 20 in such a way as to cut the communication of the second opening 31*a* with air while the carriage 20 is in the standby position, and to communicate the second opening 31*a* with air when the carriage 20 is moved so that the operating projection 22*a* is positioned in the start portion (position a in FIG. 10) of the exit path. Therefore, with the adoption of the movement preventive means thus arranged, a favorable capping condition is obtainable in the standby position.

Furthermore, assuming that the switching valve 35 operates to communicate the second opening 31*a* with the air when the carriage 20 is in the standby position and release the second opening 31*a* from communicating with air when the carriage 20 is moved so that the operating projection 22*a* is positioned in the start portion (position a in FIG. 10) of the exit passage, that is, the position of the proper suction and that of draining suction are reversely changed. However, this arrangement is undesirable because the ink at the tip ends of the nozzles are to be exposed to the air when the carriage 20 is in the standby position.

On the contrary, according to the embodiment of the invention described above, the switching valve 35 is arranged so as to cut the communication of the second opening 31*a* with the air while the carriage 20 is in the standby position and to communicate the second opening 31*a* with the air when the carriage 20 is moved to position the operating projection 22*a* in the start portion (position a in FIG. 10) of the exit path. With the adoption of the movement preventive means thus arranged, a favorable capping condition is obtainable in the standby position.

Additionally, since the switching gear 73 is designed to transmit the motive power of the motor to the paper conveying means when it is in the non-transfer position where the motive power of the motor 70 is not transmitted to the pump driving mechanism, one motor 70 can be used for selectively driving the paper conveying means and the suction pump.

Although a description has been given of an embodiment of the present invention, the invention is not limited to the embodiment thereof but may be modified without departing from the spirit and scope of the invention.

What is claimed is:

1. An ink-jet printer comprising:

a carriage which reciprocates in a direction perpendicular to a direction in which printing paper is conveyed by a paper conveyor;

a head for printing characters by sending jets of ink from the nozzles formed on an ink-jet face to printing paper, the head being fitted to the carriage;

a cap, adaptable to join tightly to the ink-jet face of the head;

a suction pump communicating with the cap;

a pump driving mechanism which drives the suction pump;

a motor which drives the pump driving mechanism;

a switching gear having a transfer position where the motive power of the motor is transmitted to the pump driving mechanism and a non-transfer position where the motive power thereof is not transmitted to the pump driving mechanism;

an operating projection fitted to the carriage to move in a direction intersecting the reciprocating direction of the carriage;

a path forming member forming paths through which the operating projection passes; and a changeover holder, having a driven portion, which operates to shift and hold the switching gear to one of the transfer and non-transfer positions when the driven portion is brought into contact with the operating projection;

the path forming member having an operating path where the changeover holder is actuated when the operating projection passes therethrough, and a non-operating path where the changeover holder is not actuated when the operating projection passes therethrough.

2. An ink-jet printer as claimed in claim 1, further comprising a cleaning device which cleans the ink-jet face when the carriage reciprocates so as to bring the ink-jet face in slidable contact with cleaning device, and wherein a length of the non-operating path in the reciprocating direction of the carriage is not less than a stroke of reciprocation of the carriage necessary to perform the cleaning.

3. An ink-jet printer as claimed in claim 1, wherein said switching gear transmits the motive power of the motor to the paper conveyor when said switching gear is in the non-transfer position where the motive power of the motor is not transmitted to the pump driving mechanism.

4. The ink-jet printer according to claim 1, wherein said changeover holder remains stationary.

5. An ink-jet printer comprising:

a carriage which reciprocates in a direction perpendicular to a direction in which printing paper is conveyed by paper conveyor;

a head for printing characters by sending jets of ink from the nozzles formed on an ink-jet face to printing paper, the head being fitted to the carriage;

a printing area where characters are printed on printing paper by the head;

a nonprinting area where characters are not printed on the printing paper by the head, the nonprinting area being outsider the printing area;

a cap adaptable to join tightly to the ink-jet face of the head, the cap being within the nonprinting area;

a suction pump communicating with the cap;

a pump driving mechanism which drives the suction pump;

a motor which drives the pump driving mechanism;

a switching gear having a transfer position where the motive power of the motor is transmitted to the pump driving mechanism and a non-transfer position where the motive power thereof is not transmitted to the pump driving mechanism;

an operating projection fitted to the carriage to move in a direction intersecting the reciprocating direction of the carriage;

a path forming member forming paths through which the operating projection passes;

a changeover holder, having a driven portion, which operates to shift and hold the switching gear to one of the transfer and non-transfer positions when the driven portion is brought into contact with the operating projection; and a movement preventor which prevents the carriage from moving toward the printing area while no printing operation is being performed by the head when the carriage is in a standby position provided in the nonprinting area, the movement preventor includes a blocking wall, adaptable to contact the operating projection and provided closer to the printing area than the position of the operating projection in the path when the carriage is in the standby position.

6. An ink-jet printer as claimed in claim 5, wherein the paths include an entry path through which the operating projection passes when the carriage enters the nonprinting area and an exit path through which the operating projection passes when the carriage escapes from the nonprinting area into the printing area, the blocking wall is provided proximate to an end of the entry passage, and a start position of the exit path is displaced from the end portion in a directing opposite to the printing area.

7. An ink-jet printer as claimed in claim 6, wherein the cap includes a first opening in communication with the suction pump, a second opening, different from the first opening and adaptable to communicate with an outside atmosphere, and a switching valve coupled to the second opening, the cap moves together with the carriage when the carriage is moved, and the switching valve is switched in response to the movement of the carriage so as to cut off communication of the second opening with the atmosphere when the carriage is in the standby position and to establish communication between the second opening with the atmosphere when the carriage is moved so that the operating projection is positioned in the start portion of the exit path.

8. An ink-jet printer as claimed in claim 5, wherein said switching gear transmits the motive power of the motor to the paper conveyor when said switching gear is in the non-transfer position where the motive power of the motor is not transmitted to the pump driving mechanism.

9. An apparatus for use with an ink jet printer, the printer including a carriage on which a print head is disposed and from which an operating projection projects, a cap for capping the print head, a suction pump for applying a negative pressure to the cap when the cap is fitted to the print head, and a motor which drives the suction pump, said apparatus comprising:

a path forming member having paths through which the operating projection of the carriage passes when the carriage moves;

a switching gear switchable between a first position which causes the motor to drive the suction pump, and a second position which prevents the motor from driving the suction pump; and a changeover holder which is controlled by movement of the operating projection through the paths to shift and hold the switching gear into the first and second positions.

10. An apparatus as claimed in claim 9, wherein the changeover holder has driven portions which project into at least one of the paths such that said operating projection contacts said driven portions to control said changeover holder.

11. An apparatus as claimed in claim 10, wherein at least one of the paths is a non-operating path such that the changeover holder is not actuated when the operating projection passes therethrough.

12. An apparatus as claimed in claim 9, wherein the path forming apparatus comprises a movement preventor which prevents the carriage from moving toward the printing area while no printing operation is being performed by the head, the movement preventor includes a blocking wall, adaptable to contact the operating projection to prevent the carriage from moving.

13. An apparatus as claimed in claim 12, wherein the paths include:

an entry path through which the operating projection passes when the carriage enters a nonprinting area of the ink jet printer in which no printing is performed; and an exit path through which the operating projection passes when the carriage escapes from the nonprinting area into a printing area of the ink jet printer in which printing is performed, the blocking wall being provided proximate to an end of the entry passage, and a start position of the exit path is displaced from the end portion in a directing opposite to the printing area.

14. The apparatus according to claim 9, wherein said changeover holder remains stationary.

15. A method for use with an ink jet printer, including a carriage on which a print head is disposed and from which an operating projection projects, a cap adaptable to cap the print head, a suction pump for applying a negative pressure to the cap when the cap is fitted to the print head, and a motor adaptable to drive the suction pump, said method comprising the steps of:

directing the operating projection of the carriage through a plurality of paths of a path forming member in accordance with movement of the carriage; and directing the operating projection through one of said paths to contact a changeover mechanism, which selectively shifts a switching mechanism into a first position to cause the motor to drive the suction pump and a second position to prevent the motor from driving the suction pump, so as to control said changeover mechanism to shift said switch mechanism into said first position; and directing the operating projection through another one of said paths to contact said changeover mechanism so as to control said changeover mechanism to shift said switch mechanism into said second position.

16. A method as claimed in claim 15, wherein said method further comprises the step of directing the operating projection to contact a movement preventor to prevent the carriage from moving toward the printing area while no printing operation is being performed by the head.

17. A method as claimed in claim 15, further comprises the steps of:

moving a cleaning device to a position in contact with an ink-jet face of the head; and moving the carriage in a reciprocating direction so that the ink-jet face slides across the cleaning device.

18. The method according to claim 15, wherein said changeover holder remains stationary.

* * * * *